US006905184B2

(12) United States Patent
Sayama

(10) Patent No.: US 6,905,184 B2
(45) Date of Patent: Jun. 14, 2005

(54) LIQUID JETTING APPARATUS

(75) Inventor: Tomohiro Sayama, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 105 days.

(21) Appl. No.: 10/255,104

(22) Filed: Sep. 26, 2002

(65) Prior Publication Data

US 2003/0103096 A1 Jun. 5, 2003

(30) Foreign Application Priority Data

Sep. 27, 2001 (JP) ..... 2001-297398
Dec. 25, 2001 (JP) ..... 2001-392438

(51) Int. Cl.[7] ..... B41J 29/38; B41J 2/165
(52) U.S. Cl. ..... 347/9; 347/27; 347/32
(58) Field of Search ..... 347/9, 10, 11, 347/20, 27, 19, 68, 70, 65, 22, 29, 5

(56) References Cited

U.S. PATENT DOCUMENTS 6,070,959 A * 6/2000 Kanbayashi et al. ..... 347/11
6,715,852 B2 * 4/2004 Yonekubo ..... 347/10

FOREIGN PATENT DOCUMENTS

JP 5-238008 A 9/1993
JP 6293135 A 10/1994
JP 9-201960 8/1997
JP 10-119271 5/1998
JP 2001-260369 A 9/2001

* cited by examiner

*Primary Examiner*—Lamson Nguyen
*Assistant Examiner*—Leonard Liang
(74) *Attorney, Agent, or Firm*—Sughrue Mion, PLLC

(57) ABSTRACT

The invention is a liquid jetting apparatus including: a head member having a plurality of nozzles, the nozzles being classified into n classes, n being not less than two; a micro-vibrating unit that causes liquid in a nozzle or nozzles of the respective classes to respectively minutely vibrate; and a micro-vibrating controlling unit that causes the micro-vibrating unit to operate. The micro-vibrating controlling unit is adapted to cause the micro-vibrating unit to operate in such a manner that the liquid in the nozzle or nozzles of the respective classes minutely vibrates at a common constant period T and at respective phases for the respective classes, the respective phases for the respective classes being different in turn by T/n.

6 Claims, 20 Drawing Sheets

LIQUID JETTING APPARATUS

TECHNICAL FIELD

This invention relates to a liquid jetting apparatus having a head member capable of jetting liquid from nozzles, such as an ink-jet recording apparatus having a recording head capable of jetting drops of ink from nozzles to achieve a recording operation. In particular, this invention is related to a liquid jetting apparatus that can prevent viscosity of liquid in nozzles from increasing.

BACKGROUND ART

An ink-jet recording apparatus such as an ink-jet printer or an ink-jet plotter moves a recording head in a main scanning direction and moves a recording paper (a kind of recording medium) in a subordinate scanning direction. Cooperating with the movement, drops of ink are jetted from nozzles of the recording head, so that an image (or a character) can be recorded. The drops of the ink are jetted for example by causing pressure generating chambers communicating with the nozzles to expand and contract.

The ink in the nozzles of the recording head is exposed to air. Thus, solvent of the ink such as water may gradually evaporate to increase a viscosity of the ink in the nozzles. In the case, quality of printed (recorded) images may deteriorate because the ink having a great viscosity may be jetted toward a direction deviated from a normal direction.

To prevent the viscosity of the ink in the nozzles from increasing, some measures have been proposed. One of the measures is to cause a meniscus of the ink to minutely vibrate to stir the ink. The meniscus means a free surface of the ink exposed at an opening of the nozzle.

For stirring the ink, the meniscus may be vibrated to a jetting direction of the ink and to a contracting direction opposed to the jetting direction by turns in such a manner that the ink may not be jetted. The vibration of the meniscus can be also carried out by expanding and contracting of the pressure chambers. Owing to the vibration of the meniscus, the ink at the opening of the nozzle may be stirred to prevent the viscosity of the ink from increasing.

The stirring of the ink may be carried out during a recording operation. For example, the stirring may be carried out while a carriage carrying the recording head is being accelerated after starting a main scanning, or while a recording (printing) operation for a line is being carried out. In the stirring while the carriage is being accelerated, a micro-vibrating operating signal for micro vibrating is supplied to the recording head to cause all menisci in the nozzles to minutely vibrate. In the stirring while the recording operation is being carried out, a pulse signal for micro vibrating is generated from a jetting operating signal for jetting ink, and the pulse signal is supplied to the recording head. Thus, the ink in the nozzles not in the recording (jetting) operation may be stirred.

The pressure generating chambers may be caused to expand and contract for example by causing piezoelectric members provided in contact with walls defining the pressure generating chambers to extend and contract.

In addition, Japanese Patent Laid-Open Publication No.2000-21507 has described that it is effective to cause menisci of ink in nozzles to minutely vibrate during a predetermined time from a suitable timing just before jetting a drop of the ink, or from a suitable timing just before jetting a drop of the ink till another suitable timing just before jetting a drop of the ink.

When the menisci are caused to vibrate by means of the piezoelectric members or the like, noise may be generated from the piezoelectric members or the like, which may become a problem. Especially, when amplitude of the vibration is increased to enhance the effect of the micro-vibrating operation, the noise also may be increased. Herein, it is said that a hearable frequency band of a human being is 20 to 20000 Hz, as shown in FIG. 19. Especially, a human being can hardly hear noise whose frequency is not less than 15 kHz. Thus, it is preferable that the piezoelectric members or the like is operated at a frequency not less than 15 kHz.

However, when the ink includes a solid component such as pigment, if the frequency of the micro-vibration is raised too much, the nozzles may drip with the ink, so that the ink may not be jetted from the nozzles accurately but deflected. In general, a suitable micro-vibrating frequency depends on natural frequency TM of the nozzles.

In addition, in general, the micro-vibrating operating signal is formed as a signal wherein the same pulse wave repeatedly appears at a predetermined frequency. If the frequency is not high enough, the effect of recovering viscosity of the ink from an increased state thereof may not be sufficiently achieved.

Through carrying out various experiments regarding the effect of recovering the viscosity of the ink from an increased state thereof, the inventor has found that: if the above frequency is not less than 10.8 kHz, deflection of firstly jetted drop of the ink can be substantially completely prevented.

To the contrary, if the frequency is too high, the nozzle may drip with the ink, so that the ink may not be jetted from the nozzle accurately but deflected.

Through carrying out various experiments regarding generation of the dripping with the ink at the nozzle, the inventor has found that: if the above frequency is not more than 25.0 kHz, the dripping with the ink at the nozzle can be substantially completely prevented.

That is, in order to recover the viscosity of the ink from an increased state thereof and to prevent generation of the dripping with the ink at the nozzle, it is sufficient that the above frequency is not less than 10.8 kHz and not more than 25.0 kHz.

Herein, if an actuator (micro-vibrating unit) for causing the pressure generating chambers to expand and contract in order to carry out a micro-vibrating operation consists of a PZT device (piezoelectric member), the above frequency corresponds to a driving frequency of the PZT device. In general, when a PZT device is driven at a frequency, noise of the frequency is generated.

It is said that a hearable frequency region for a human ear is 20 Hz to 20 kHz. Among the region, it is said that a barbarous frequency region is 1 kHz to 16 kHz. That is, for the human ear, a sound having a frequency not more than 1 kHz and a sound having a frequency not less than 16 kHz are not barbarous.

That is, in view of suppressing generation of the noise from the ink-jetting apparatus, it is sufficient that the above frequency is not more than 1 kHz or not less than 16 kHz.

Thus, a suitable range for the above frequency is not less than 16 kHz and not more than 25 kHz, with respect to all the above points, that is, recovering the viscosity of the ink from an increased state thereof, preventing generation of the dripping with the ink at the nozzle, and suppressing generation of the noise.

In the suitable range, the inventor planed to adopt a frequency of 17.27 kHz as a standard specification for a micro-vibrating signal.

However, the inventor has found that: if the frequency of 17.27 kHz is set, the following problem may arise.

For example, if the micro-vibrating unit is formed by a PZT device as described above, an electric circuit for driving the PZT device is necessary in general. In the electric circuit, transistors are used.

However, a driving frequency of 17.27 kHz may cause the transistors in the electric circuit to generate great heat, which may cause various problems.

In order to solve the problem regarding the heat generation of the transistors, some measures maybe proposed, such as arranging a large heat sink or arranging a fan. However, these measures may raise costs.

As shown in table 1, the inventor has found that: it is preferable to lower the driving frequency of the PZT device to 13 kHz or less, in view of forming the electric circuit.

TABLE 1

| Micro-Vibrating Frequency | Transistor-Heat-Generation | Judgement |
|---|---|---|
| 17.27 kHz | 163.3° C. | x |
| 16.0 kHz | 154.4° C. | x |
| 13.0 kHz | 133.6° C. | ○ |

Integrating the above aspects by the inventor, while a suitable range for the above frequency is not less than 16 kHz and not more than 25 kHz with respect to the three points of: recovering the viscosity of the ink from an increased state thereof, preventing generation of the dripping with the ink at the nozzle, and suppressing generation of the noise, a suitable range for the above frequency is not more than 13 kHz with respect to easiness of forming a driving circuit for the micro-vibrating unit. Thus, there is no frequency region satisfying the above both ranges.

SUMMARY OF THE INVENTION

The object of this invention is to solve the above problems, that is, to provide a liquid jetting apparatus such as an ink-jet recording apparatus that can maintain a suitable micro-vibrating frequency and that can remarkably reduce noise during a micro-vibrating operation.

The invention is a liquid jetting apparatus including: a head member having n nozzles, n being not less than two; a micro-vibrating unit that causes liquid in the respective nozzles to respectively minutely vibrate; and a micro-vibrating controlling unit that causes the micro-vibrating unit to operate; wherein the micro-vibrating controlling unit is adapted to cause the micro-vibrating unit to operate in such a manner that the liquid in the respective nozzles minutely vibrates at a common constant period T and at respective phases for the respective nozzles, the respective phases for the respective nozzles being different in turn by T/n.

According to the invention, while the liquid in all the nozzles minutely vibrates at a common constant period T, the liquid in the respective nozzles minutely vibrates at the respective phases different in turn by T/n. Thus, while the micro-vibrating frequency of the liquid in the respective nozzles can be maintained at a predetermined level, the frequency of noise can be raised to n times as much as the micro-vibrating frequency, so that the noise can be out of a human hearable frequency band. In addition, since the vibrating timings (phases) in the respective nozzles are different, volume of the noise itself may be reduced as well.

The liquid in the respective nozzles maybe caused to minutely vibrate at a suitable frequency depending on natural frequency TM of the nozzles, for example a common frequency of 7 to 10 kHz, and at respective phases for the respective nozzles different in turn by 1/n of the period.

In addition, the invention is a liquid jetting apparatus including: a head member having a plurality of nozzles, the nozzles being classified into n classes, n being not less than two; a micro-vibrating unit that causes liquid in a nozzle or nozzles of the respective classes to respectively minutely vibrate; a micro-vibrating controlling unit that causes the micro-vibrating unit to operate; wherein the micro-vibrating controlling unit is adapted to cause the micro-vibrating unit to operate in such a manner that the liquid in the nozzle or nozzles of the respective classes minutely vibrates at a common constant period T and at respective phases for the respective classes, the respective phases for the respective classes being different in turn by T/n, the phases being respectively common in the respective classes.

According to the invention, while the liquid in all the nozzles minutely vibrates at a common constant period T, the liquid in the nozzle or nozzles of the respective classes minutely vibrates at the respective phases different in turn by T/n, the phases being respectively common in the respective classes. Thus, while the micro-vibrating frequency of the liquid in the respective nozzles can be maintained at a predetermined level, the frequency of noise can be raised to n times as much as the micro-vibrating frequency, so that the noise can be out of a human hearable frequency band. In addition, since the respective vibrating timings (phases) in the respective classes are different, volume of the noise itself may be reduced as well.

The liquid in the respective nozzles may becaused to minutely vibrate at a suitable frequency depending on natural frequency TM of the nozzles, for example a common frequency of 7 to 10 kHz, and at respective phases for the respective classes different in turn by 1/n of the period.

For example, at least one of the classes includes a plurality of nozzles. Then, liquid in the nozzles of the at least one of the classes is a same kind of liquid, for example a same color of ink.

The micro-vibrating controlling unit may have: a micro-vibrating-signal generating unit that generates a common micro-vibrating signal; a micro-vibrating-mode-signal generating unit that generates respective micro-vibrating mode signals depending on the respective classes; a signal fusing part that generates respective micro-vibrating operating signals being AND signals of the common micro-vibrating signal and the respective micro-vibrating mode signals; and a main controlling part that causes the micro-vibrating unit to operate based on the respective micro-vibrating operating signals.

In the case, for example, the common micro-vibrating signal is a periodical signal of a period including a predetermined waveform, and each micro-vibrating mode signal is a periodical signal of a same period as the common micro-vibrating signal including a or more predetermined rectangular pulses.

Preferably, the common micro-vibrating signal is a periodical signal having a frequency not less than 15 kHz.

The micro-vibrating unit may have a piezoelectric member that causes a meniscus of liquid in a nozzle to minutely vibrate by deforming a pressure generating chamber communicating with the nozzle and capable of containing the liquid. In the case, noise generated by driving the piezoelectric member may be remarkably reduced.

For example, the liquid is ink including a pigment component, and the head member is a recording head.

In addition, the invention is a liquid jetting apparatus including: a head member having at least two nozzles; a micro-vibrating unit that causes liquid in the respective nozzles to respectively minutely vibrate; and a micro-vibrating controlling unit that causes the micro-vibrating unit to operate; wherein the micro-vibrating controlling unit is adapted to cause the micro-vibrating unit to operate in such a manner that a frequency or respective frequencies at which the liquid in the respective nozzles minutely vibrates are different from a composite frequency by micro-vibration of the liquid in all the nozzles.

According to the invention, the composite frequency by micro-vibration of the liquid in all the nozzles can be controlled to be different from the respective frequencies at which the liquid in the respective nozzles minutely vibrates. Thus, while the micro-vibrating frequency of the liquid in the respective nozzles can be maintained at a predetermined level, the frequency of noise can be raised, so that the noise can be out of a human hearable frequency band. In addition, if vibrating timings (phases) in the respective nozzles are different, volume of the noise itself may be reduced as well.

Preferably, the composite frequency by micro-vibration of the liquid in all the nozzles is not less than 100 Hz, because it is said that sound whose frequency is less than 100 Hz is harmful to human beings. More preferable second frequency is not less than 400 Hz and not more than 500 Hz, for example in the vicinity of 480 Hz.

In addition, the invention is a controlling unit for controlling a liquid jetting apparatus including: a head member having n nozzles, n being not less than two; and a micro-vibrating unit that causes liquid in the respective nozzles to respectively minutely vibrate; the controlling unit being adapted to cause the micro-vibrating unit to operate in such a manner that the liquid in the respective nozzles minutely vibrates at a common constant period T and at respective phases for the respective nozzles, the respective phases for the respective nozzles being different in turn by T/n.

In addition, the invention is a controlling unit for controlling a liquid jetting apparatus including: a head member having a plurality of nozzles, the nozzles being classified into n classes, n being not less than two; and a micro-vibrating unit that causes liquid in a nozzle or nozzles of the respective classes to respectively minutely vibrate; the controlling unit being adapted to cause the micro-vibrating unit to operate in such a manner that the liquid in the nozzle or nozzles of the respective classes minutely vibrates at a common constant period T and at respective phases for the respective classes, the respective phases for the respective classes being different in turn by T/n, the phases being respectively common in the respective classes.

In addition, the invention is a controlling unit for controlling a liquid jetting apparatus including: a head member having at least two nozzles; and a micro-vibrating unit that causes liquid in the respective nozzles to respectively minutely vibrate; the controlling unit being adapted to cause the micro-vibrating unit to operate in such a manner that a frequency or respective frequencies at which the liquid in the respective nozzles minutely vibrates are different from a composite frequency by micro-vibration of the liquid in all the nozzles.

In addition, the object of this invention is to provide an ink-jet recording apparatus that can achieve a micro-vibrating control suitable for all points of: recovering viscosity of ink from an increased state thereof, preventing generation of dripping with the ink at a nozzle, suppressing generation of noise, and easiness of forming a driving circuit for a micro-vibrating unit. Furthermore, more broadly, the object of this invention is to provide a liquid jetting apparatus including a head member having a nozzle for jetting liquid that can achieve a micro-vibrating control suitable for all points of: recovering viscosity of the liquid from an increased state thereof, preventing generation of dripping with the liquid at the nozzle, suppressing generation of noise, and easiness of forming a driving circuit for a micro-vibrating unit.

The invention is a liquid jetting apparatus including: a head member having a nozzle; a micro-vibrating unit that causes liquid in the nozzle to minutely vibrate; a micro-vibrating-controlling-signal generating unit that generates a micro-vibrating controlling signal; and a micro-vibrating controlling unit that causes the micro-vibrating unit to operate, based on the micro-vibrating controlling signal; wherein the micro-vibrating-controlling-signal generating unit is adapted to generate a micro-vibrating controlling signal as a signal in which a unit waveform is repeated at a second frequency, the unit waveform including in order a first waveform part in which a pulse waveform appears at a first frequency and a second waveform part in which no pulse waveform appears.

According to the invention, a feature of the first waveform part is dominant with respect to the three points of: recovering the viscosity of the liquid from an increased state thereof, preventing generation of the dripping with the liquid at the nozzle, and easiness of forming a driving circuit for the micro-vibrating unit, but frequency of the noise that may be generated from the unit of the invention is the second frequency.

Thus, if the first frequency is set based on a frequency suitable for the three points of: recovering the viscosity of the liquid from an increased state thereof, preventing generation of the dripping with the liquid at the nozzle, and easiness of forming a driving circuit for the micro-vibrating unit, and the second frequency is set based on a frequency suitable for suppressing generation of the noise, a micro-vibrating control can be achieved suitable for all the points of: recovering the viscosity of the liquid from an increased state thereof, preventing generation of dripping with the liquid at the nozzle, suppressing generation of the noise, and easiness of forming a driving circuit for the micro-vibrating unit.

Concretely, in order to recover the viscosity of the liquid from an increased state thereof and to prevent generation of dripping with the liquid at the nozzle, when a ratio of a continuing time of the first waveform part with respect to a continuing time of the unit waveform is represented by r, a product of the first frequency and r is not less than 10.8 kHz and not more than 25.0 kHz.

Alternatively, for easiness of forming a driving circuit for the micro-vibrating unit, a product of the first frequency and r is not more than 13 kHz.

Alternatively, for recovering the viscosity of the liquid from an increased state thereof, preventing generation of dripping with the liquid at the nozzle, and easiness of forming a driving circuit for the micro-vibrating unit, a product of the first frequency and r is not less than 10.8 kHz and not more than 13 kHz.

Alternatively, the second frequency is not less than 100 Hz, because it is said that sound whose frequency is less than 100 Hz is harmful to human beings. More preferable second frequency is not less than 400 Hz and not more than 500 Hz, for example in the vicinity of 480 Hz.

In addition, preferably, the second frequency is not more than 1.0 kHz.

A ratio between a continuing time of the first waveform part (the number of pulse waveforms generated at the first frequency) and a continuing time of the second waveform part may be suitably determined, especially based on requirements for easiness of forming a driving circuit for the micro-vibrating unit.

Preferably, the micro-vibrating unit has a piezoelectric vibrating member. In addition, in the case, the micro-vibrating controlling unit may have a transistor circuit for driving the piezoelectric vibrating member.

Although the transistor circuit may generate heat when driven at a high first frequency, the transistor circuit is not driven and radiates the heat for a time corresponding to the second waveform part. Thus, it is unnecessary to carefully consider the heat-generation problem of the transistor circuit.

The above respective controlling units or the above respective units (means) may be materialized by a computer system.

A program for materializing the respective controlling units or the respective units (means) in the computer system, and a storage medium storing the program capable of being read by a computer, should be protected by the application as well.

The storage unit may be not only a substantial object such as a floppy disk or the like, but also a network for transmitting various signals.

BRIEF DESCRIPTION OF THE DRAWINGS

FIGS. 5A and 5B are views for explaining structure of a recording head, wherein FIG. 5A is a sectional view of the recording head and FIG. 5B is an enlarged view of the A portion of the FIG. 5A;

BEST MODE FOR CARRYING OUT THE INVENTION

Figure 1:
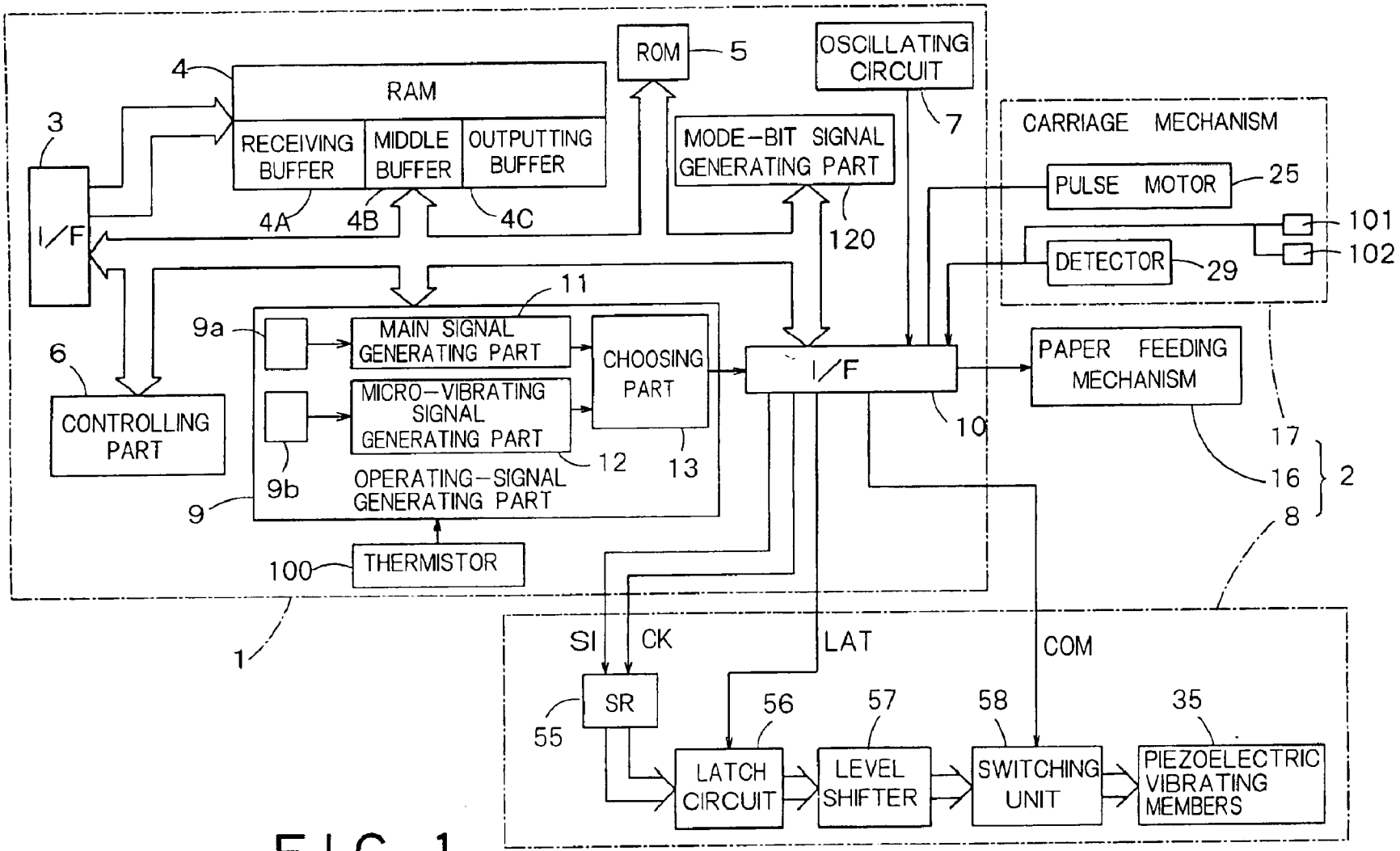
FIG. 1 is a schematic block diagram for explaining structure of an ink-jetting printer according to an embodiment of the invention.

An embodiment of the invention is described with reference to drawings. As shown in FIG. 1, the liquid jetting apparatus of the embodiment is an ink-jetting printer (ink-jet recording apparatus) having a printer controller 1 and a print engine 2.

The printer controller 1 has: an outside interface (outside I/F) 3, a RAM 4 that is able to temporarily store various data, a ROM 5 which stores a controlling program or the like, a controlling part 6 including CPU or the like, an oscillating circuit 7 for generating a clock signal, an operating-signal generating part 9 for generating an operating signal that is to be supplied into a recording head 8 (head member), and an inside interface (inside I/F) 10 that is adapted to send the operating signal, dot-pattern-data (bit-map-data) developed according to printing data, or the like to the print engine 2.

The outside I/F 3 is adapted to receive printing data consisting of character codes, graphic functions, image data or the like from a host computer not shown or the like. In addition, a busy signal (BUSY) or an acknowledge signal (ACK) is adapted to be outputted to the host computer or the like through the outside I/F 3.

The RAM 4 has: a receiving buffer 4A, an intermediate buffer 4B, an outputting buffer 4C and a work memory not shown. The receiving buffer 4A is adapted to receive the printing data through the outside I/F 3, and temporarily store the printing data. The middle buffer 4B is adapted to store middle-code-data converted from the printing data by the controlling part 6. The outputting buffer 4C is adapted to store dot-pattern-data, which are recording-data obtained by decoding (translating) the middle-code-data. The middle-code-data may be for example gradation data.

The ROM 5 stores font data, graphic functions or the like in addition to the controlling program (controlling routine) for carrying out various data-processing operations.

The controlling part 6 is adapted to carry out various controlling operations according to the controlling program stored in the ROM 5. For example, the controlling part 6 reads out the printing data from the receiving buffer 4A, converts the printing data into the middle-code-data, and causes the middle buffer 4B to store the middle-code-data.

Then, the controlling part 6 analyzes the middle-code-data in the middle buffer 4B and develops (decodes) the middle-code-data into the dot-pattern-data with reference to the font data and the graphic functions or the like stored in the ROM 5. Then, the controlling part 6 carries out necessary decorating operations to the dot-pattern-data, and thereafter causes the outputting buffer 4C to store the dot-pattern-data.

When the dot-pattern-data corresponding to one line recorded by one main scanning of the recording head 8 are obtained, the dot-pattern-data are outputted to the recording head 8 from the outputting buffer 4C through the inside I/F 10 in turn. When the dot-pattern-data corresponding to the one line are outputted from the outputting buffer 4C, the middle-code-data that has been developed are deleted from the middle buffer 4B, and the next developing operation starts for the next middle-code-data.

The operating-signal generating part 9 has: a main signal generating part 11 for generating a jetting operating signal that is used for recording (jetting ink) and for performing mid-recording (mid-jetting) micro-vibrating operations of meniscus 52 (see FIG. 5B), a micro-vibrating-signal generating part 12 (micro-vibrating-controlling-signal generating means) for generating a non-recording common micro-vibrating signal and a pre-recording common micro-vibrating signal that are used for performing non-recording (non-jetting) and pre-recording (pre-jetting) micro-vibrating operations of meniscus 52 (see FIG. 5B), and a choosing part 13 that is adapted to be inputted the jetting operating signal from the main signal generating part 11 and the non-recording common micro-vibrating signal or the pre-recording common micro-vibrating signal from the micro-vibrating-signal generating part 12, and to output one of the jetting operating signal, the non-recording common micro-vibrating signal and the pre-recording common micro-vibrating signal to the inside I/F 10.

Figure 2:
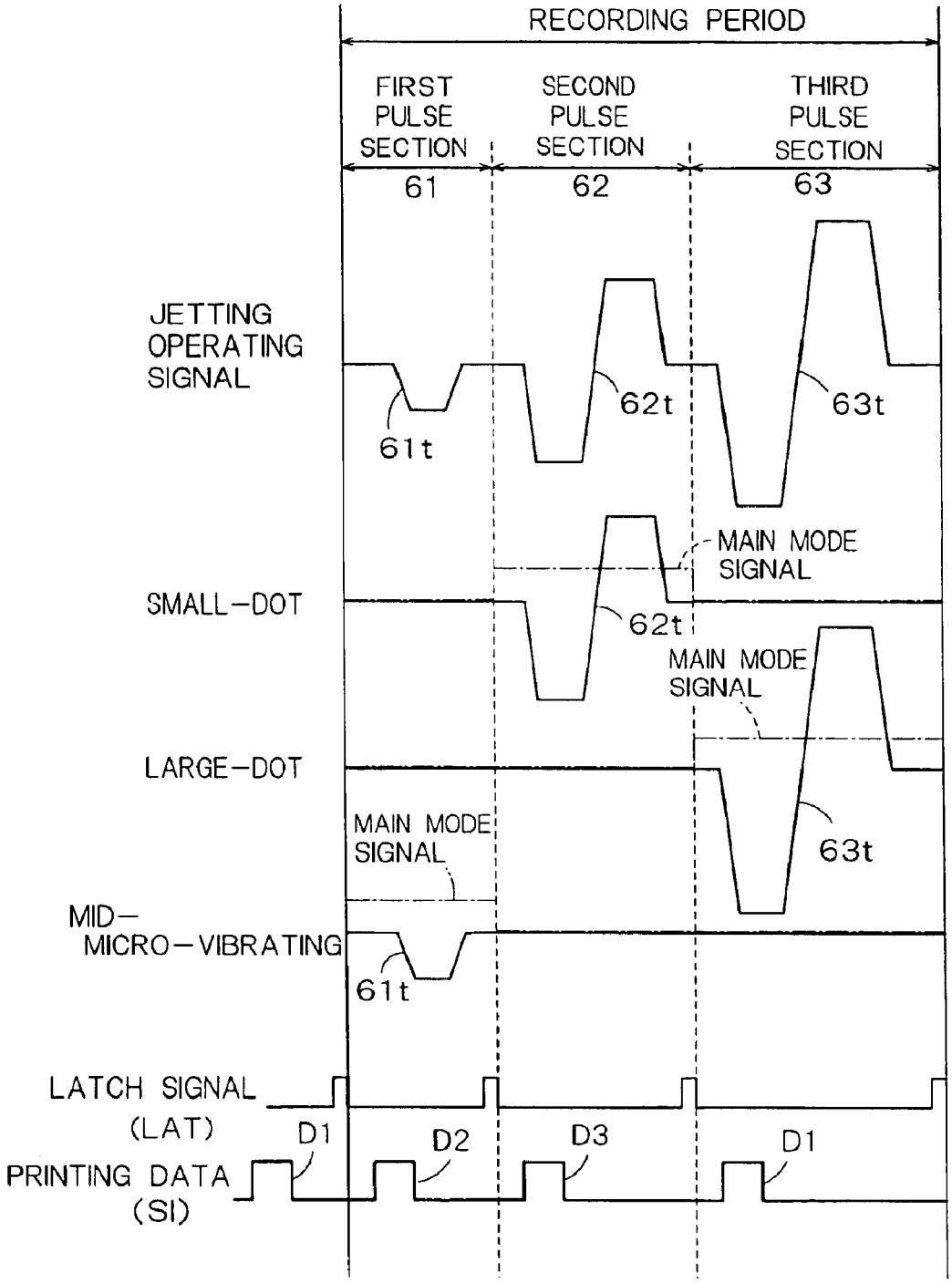
FIG. 2 is an explanatory view of a jetting operating signal and operating pulses being generated based on the jetting operating signal.

For example, as shown in FIG. 2, the jetting operating signal is a periodical signal serially including: a first pulse portion 61 having a trapezoidal waveform 61*t* that falls down from a base potential by a predetermined first potential and then rises back to the base potential; a second pulse portion 62 having a waveform 62*t* that falls down from the base potential by a predetermined second potential greater than the first potential, rises to a potential above the base potential, then falls again to the base potential; and a third pulse portion 63 having a waveform 63*t* substantially similar to the waveform 62*t* that falls down from the base potential by a predetermined third potential greater than the second potential, rises to a highest potential above the base potential, then falls again to the base potential.

Figure 3:
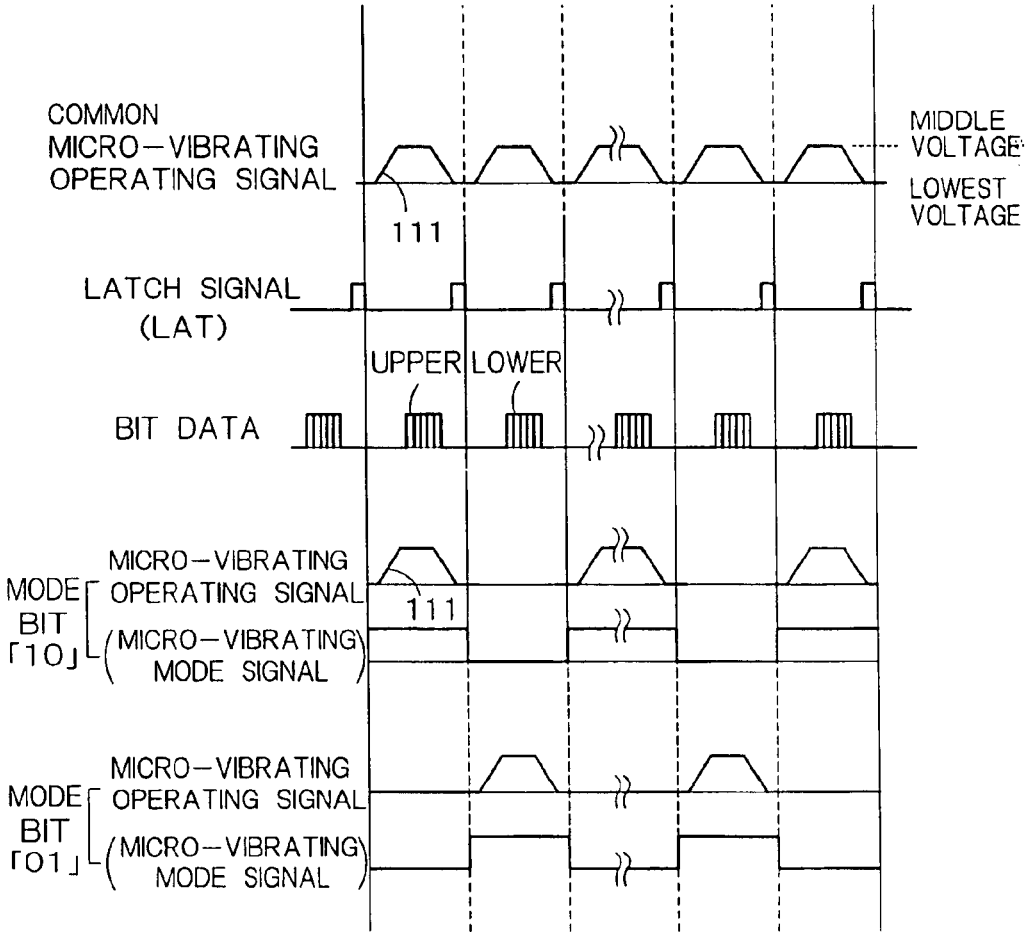
FIG. 3 is an explanatory view of an example of micro-vibrating operating signals.

On the other hand, the non-recording common micro-vibrating signal and the pre-recording common micro-vibrating signal are usually the same signal. For example, as shown in FIG. 3, the common micro-vibrating signal is formed by a periodical signal serially including trapezoidal pulses 111, each of which is switched between a lowermost potential and a middle potential, at substantially regular intervals. The trapezoidal pulse 111 appears at a frequency of 21.6 kHz.

The operating-signal generating part 9 may consist of logic circuits, or controlling circuits having a CPU, a ROM, a RAM or the like.

The print engine 2 consists of a paper feeding mechanism 16, a carriage mechanism 17 and the recording head 8.

Figure 4A:
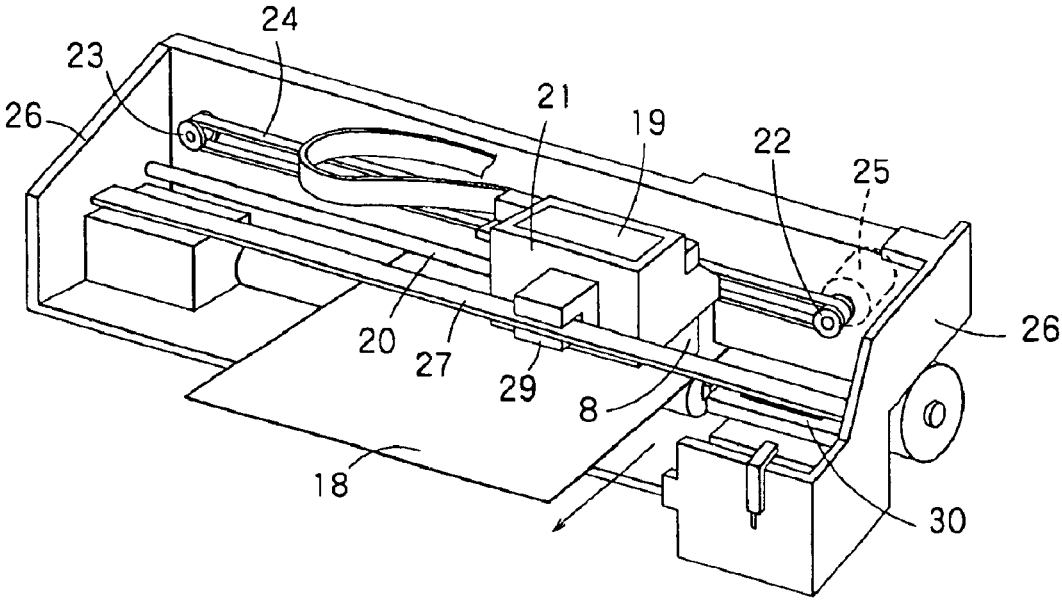
FIG. 4A is a perspective view of the ink-jetting printer shown in FIG. 1.

The paper feeding mechanism 16 consists of a paper feeding motor, a paper feeding roller and so on. As shown in FIG. 4A, a recording paper 18, which is an example of a recording medium, is fed in a paper-feeding direction, which is the subordinate scanning direction, in turn by the paper feeding mechanism 16 in cooperation with the scanning operation of the recording head 8.

Figure 4B:
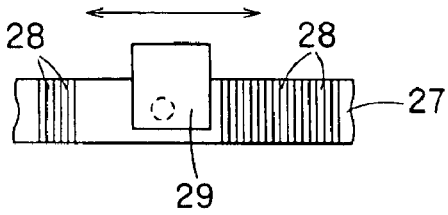
FIGS. 4B and 4C are views for explaining a linear encoder.
Figure 4C:
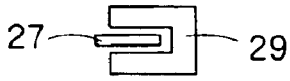

As shown in FIGS. 4A to 4C, the carriage mechanism 17 has: a carriage 21 that is slidably mounted on a guiding member 20 and is capable of carrying the recording head 8 and an ink cartridge 19, a timing belt 24 that circulates around a driving pulley 22 and a following pulley 23 and is connected with the carriage 21, a pulse motor 25 for causing the driving pulley 22 to rotate, a linear encoder 27 supported by a printer housing 26 in such a manner that the linear encoder 27 extends in a direction of width of the recording paper 18 (in the main scanning direction), and a slit detector 29 mounted on the carriage 21 and capable of detecting a plurality of slits 28 of the linear encoder 27.

As shown in FIG. 4B, the linear encoder 27 of the embodiment consists of a transparent plate, and the plurality of slits 28 is formed at pitches of 360 dpi in the linear encoder 27. For example, the slit detector 29 may consist of a photo-interrupter.

According to the carriage mechanism 17 described above, the carriage 21 can reciprocate in the width direction of the recording paper 18 (in the main scanning direction) by driving the pulse motor 25. Thus, the recording head 8 mounted on the carriage 21 can also reciprocate in the main scanning direction. The movement (reciprocation) of the carriage 21 starts from a standard position on a side of a home position. The home position means a position where the carriage 21 stands by, when the electric power is not supplied, when the scanning operation is not carried out for a long time, or the like. In the embodiment, the home position is located in a right end portion of FIG. 4A.

In the embodiment, a capping mechanism 30 is provided at the home position in order to prevent solvent of ink in nozzles 51 (described below) of the recording head 8 from evaporating.

On the other hand, the standard position is located at a little left position with respect to the home position. In detail, the standard position is located between a right end of the recording paper 18 and the capping mechanism 30.

When the carriage 21 is moved, the slit detector 29 is moved together with the carriage 21. During the movement, the slit detector 29 detects the plurality of slits 28 of the linear encoder 27 in turn, and outputs pulse-like detecting signals each of which corresponds to each of slits 28. The controlling part 6 recognizes a position of the recording head 8 based on the detecting signals from the slit detector 29.

In more detail, the controlling part 6 resets a counting value of a position counter when the carriage 21 is positioned at the standard position. Then, the controlling part 6 receives the pulse-like detecting signals outputted in turn from the slit detector 29 while the carriage 21 is moved. The counting value of the position counter increases by one whenever the controlling part 6 receives one pulse-like signal. Thus, the counting value of the position counter functions as head-position information that represents a position of the carriage 21 i.e. a scanning position of the recording head 8. The position counter may be provided in the work memory (not shown) of the RAM 4. Alternatively, the position counter may be provided separately.

Therefore, the linear encoder 27 and the slit detector 29 function as a scanning-position-information outputting unit. That is, they output information about the position of the recording head 8 (detecting signals) during the main scanning of the carriage 21 (recording head 8). The controlling part 6 and the position counter (RAM 4) function as scanning-position-holding means. That is, they hold the counting value (head-position information) that has been updated according to the detecting signals from the slit detector 29.

Figure 5A:
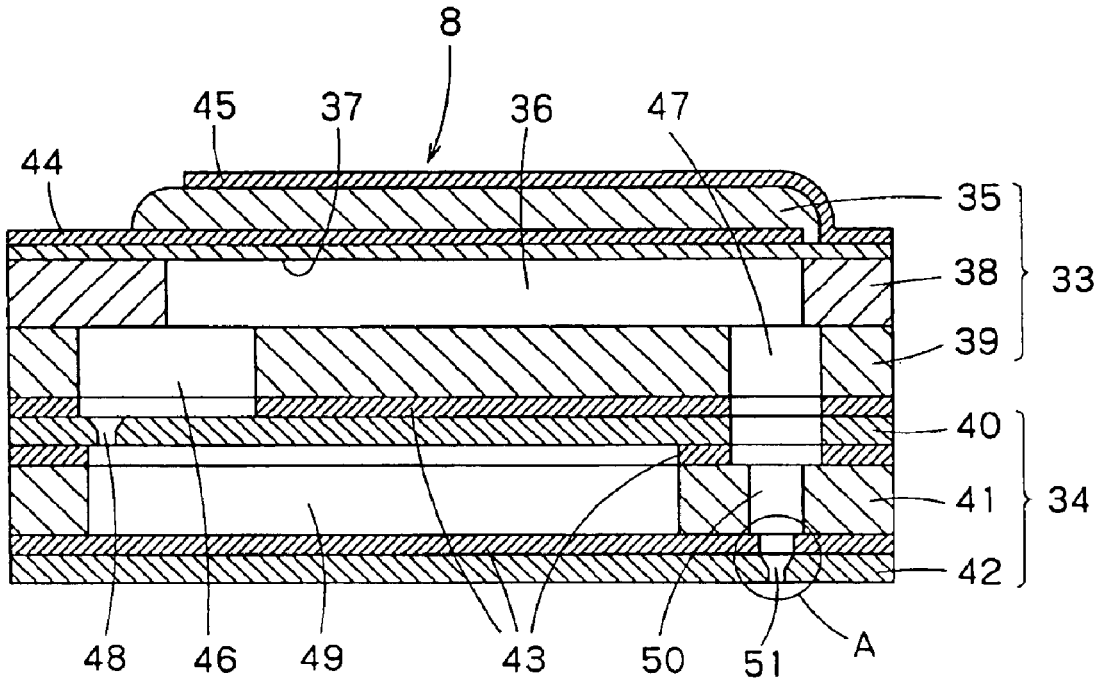

Then, the recording head 8 is explained in more detail. As shown in FIG. 5A, the recording head 8 mainly consists of an actuator unit 33 and an ink-way unit 34. The recording head 8 includes bending-mode PZT piezoelectric vibrating members 35 as pressure generating members.

When electric power is supplied to a bending-mode piezoelectric vibrating member 35, the member 35 contracts to deform a pressure generating chamber 36 in such a manner that a volume of the pressure generating chamber 36 becomes smaller. When electric charges are discharged from the bending-mode piezoelectric vibrating member 35, the member 35 expands to deform the pressure generating chamber 36 in such a manner that the volume of the pressure generating chamber 36 becomes larger.

The actuator unit 33 comprises a first lid 37, a spacer 38, a second lid 39 and piezoelectric vibrating members 35. The ink-way unit 34 comprises an ink-way forming plate 40, an ink-chamber forming plate 41 and a nozzle plate 42. The actuator unit 33 and the ink-way unit 34 are integrated by an adhesive layer 43 to form the recording head 8. The adhesive layer 43 may consist of a thermal welding film or a suitable adhesive material.

The first lid 37 may be an elastic thin plate made of ceramic in general. In the embodiment, the first lid 37 is made of zirconia ($ZrO_2$) having a thickness of about 6 $\mu$m. A common electrode 44 for the piezoelectric vibrating members 35 is formed on a reverse (upper) surface of the first lid 37. The electric vibrating members 35 are integrated on the common electrode 44 respectively. Driving electrodes 45 for the piezoelectric vibrating members 35 are provided on reverse (upper) surfaces of the piezoelectric vibrating members 35, respectively.

The spacer 38 may be a ceramic plate having penetrating holes that form pressure generating chambers 36 respectively. In the embodiment, the spacer 38 is made of a zirconia plate having a thickness of about 100 $\mu$m.

The second lid 39 may be a ceramic plate having penetrating holes that form supplying-holes 46 respectively at a left side in FIG. 5A and penetrating holes that form first-nozzle-holes 47 respectively at a right side in FIG. 5A. For example, the second lid 39 may be made of a zirconia plate.

The first lid 37 is arranged on a reverse (upper) surface of the spacer 38. The second lid 39 is arranged on a front (lower) surface of the spacer 38. That is, the spacer 38 is sandwiched between the first lid 37 and the second lid 39. Each of the first lid 37, the spacer 38 and the second lid 39 is molded into a predetermined shape out of clay-like ceramic. Then, the first lid 37, the spacer 38 and the second lid 39 are layered and integrated by baking.

The ink-way forming plate 40 may be a plate having penetrating holes that form ink-supplying-openings 48 respectively at a left side in FIG. 5A and penetrating holes that form first-nozzle-holes 47 respectively at a right side in FIG. 5A. The ink-chamber forming plate 41 may be a plate having a penetrating hole that forms an ink chamber 49 and penetrating holes that form second-nozzle-holes 50 respectively at a right side in FIG. 5A. The nozzle plate 42 may be a thin plate having nozzles 51 at a right side in FIG. 5A. The nozzles 51 are arranged at pitches (at intervals) that correspond to a density of forming dots, in the subordinate scanning direction. The number of the nozzles is for example 48. The nozzle plate 42 may be made of stainless steel.

Herein, in FIG. 5A, only one row of the nozzles 51 (and the pressure generating chambers 39) is depicted. However, the number of rows of the nozzles in the embodiment is four, which is described below with reference to FIG. 7.

The nozzle plate 42 is arranged on a front (lower) surface of the ink-chamber forming plate 41 via an adhesive layer 43. The ink-way forming plate 40 is arranged on a reverse (upper) surface of the ink-chamber forming plate 41 via an adhesive layer 43. Thus, the ink-way forming plate 40, the ink-chamber forming plate 41 and the nozzle plate 42 are integrated as the ink-way unit 34.

In the recording head 8 described above, the ink chamber 49 of the ink-way unit 34 is communicated with the supplying-holes 46 of the actuator unit 33 through the ink-supplying-openings 48 respectively. The supplying-holes 46 are communicated with the first-nozzle-holes 47 through the pressure generating chambers 36 respectively. The nozzles 51 are communicated with the first-nozzle-holes 47 through the second-nozzle-holes 50 respectively. Thus, ink-ways are formed from the ink chamber 49 to the nozzles 51 through the pressure generating chambers 36 respectively. Ink (liquid) in the ink cartridge 19 is adapted to be supplied into the ink chamber 49 through an ink supplying way not shown. In the embodiment, common ink is supplied into the respective nozzles 51.

The ink can be jetted from the nozzles 51 by changing the volumes of the pressure generating chambers 36. In more detail, when electric poser is supplied to a piezoelectric vibrating member 35, the piezoelectric vibrating member 35 contracts in a direction perpendicular to a direction of the electric field. Then, the first lid 37 is deformed in such a manner that a pressure generating chamber 36 corresponding to the piezoelectric vibrating member 35 contracts with respect to an original state thereof. On the other hand, when electric charges are discharged from the piezoelectric vibrating member 35, the piezoelectric vibrating member 35 expands in the direction perpendicular to the direction of the electric field. Then, the first lid 37 is deformed in such a manner that the pressure generating chamber 36 corresponding to the piezoelectric vibrating member 35 expands back to the original state thereof. When the pressure generating chamber 35 contracts rapidly after the pressure generating chamber 36 has expanded, a pressure of ink in the pressure generating chamber 36 increases rapidly. Thus, an ink drop is jetted from the nozzle 51 corresponding to the pressure generating chamber 36 as shown by an alternate long and short dash line in FIG. 5B.

Figure 5B:
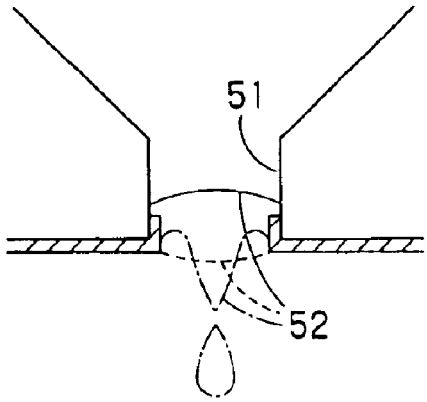

On the other hand, by causing the pressure generating chamber 36 to expand and contract in such a manner that the ink in the nozzle 51 is not jetted, the ink in the nozzle 51 can be stirred in order to prevent the viscosity of the ink from increasing. In more detail, a meniscus 52 (free surface of the ink exposed at an opening of the nozzle 51) can be caused to minutely vibrate i.e. move to a jetting direction of the ink and to a contracting direction opposed to the jetting direction by turns as shown in FIG. 5B, by causing the pressure chamber 36 to expand and contract in such a manner that the ink is not jetted. Owing to the vibration of the meniscus, the ink at the opening of the nozzle can be stirred in order to prevent the viscosity of the ink from increasing.

Then, an electric structure of the recording head 8 is explained. As shown in FIG. 1, the recording head 8 includes a shift register 55, a latch circuit 56, a level shifter 57 and a switching unit 58 and the piezoelectric vibrating members 35, which are electrically connected in the order. The shift register 55 has a plurality of shift register devices 55A to 55N each of which corresponds to each of the nozzles 51. Similarly, the latch circuit 56 has a plurality of latch devices 56A to 56N each of which corresponds to each of the nozzles 51, the level shifter 57 has a plurality of level shifter devices 57A to 57N each of which corresponds to each of the nozzles 51, and the switching unit 58 has a plurality of switching devices 55A to 55N each of which corresponds to each of the nozzles 51. In addition, each of the piezoelectric vibrating members 35 corresponds to each of the nozzles 51, so that the piezoelectric vibrating members 35 are also designated as piezoelectric vibrating members 35A to 35N. The plurality of switching devices 55A consist of transistor circuits.

Figure 7:
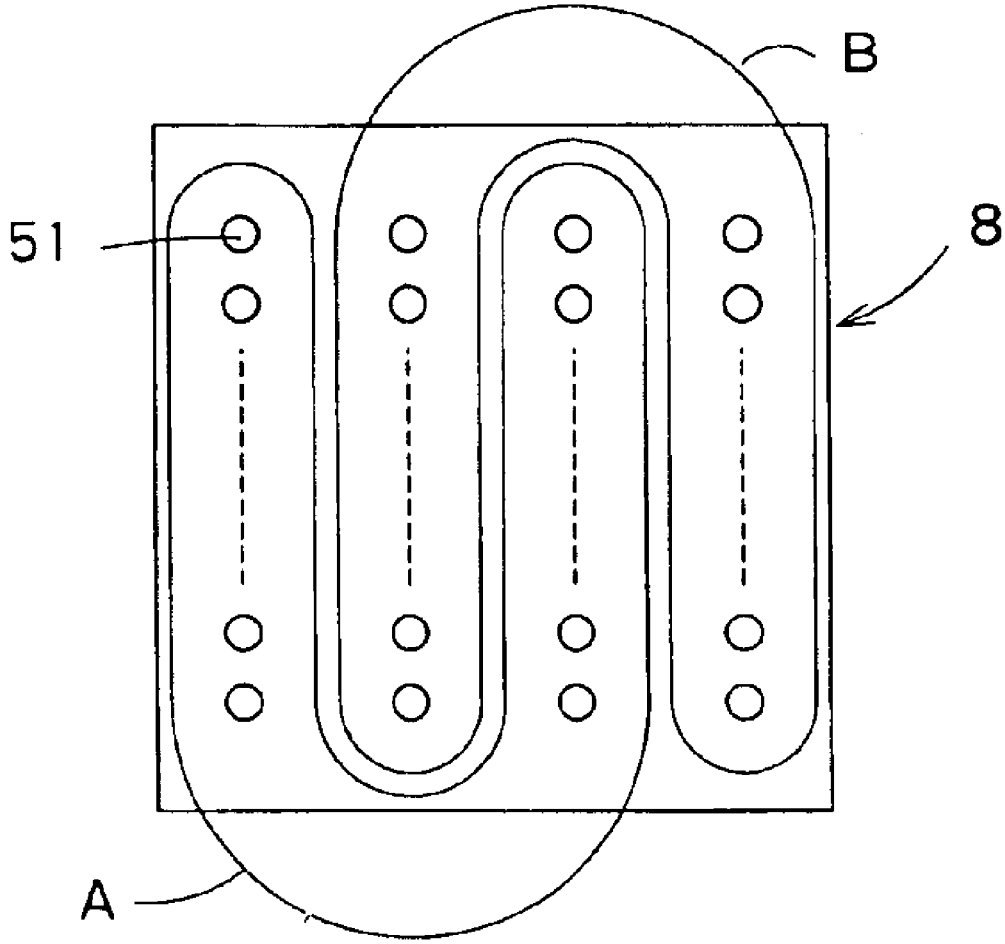
FIG. 7 is a drawing showing an example of nozzles classified into classes.

In addition, information about classes into which the nozzles are classified is transmitted to a mode-bit signal generating unit 120 via the host computer not shown and the outside I/F 3. In this case, as shown in FIG. 7, the nozzles are classified into two classes A and B that respectively include alternate nozzle rows. The mode-bit signal generating unit 120 generates a mode-bit signal corresponding to each of the classes A and B. In the case, the mode-bit signal is formed by digital data consisting of two bits of 01 or 10, so that two mode-instructions are achieved (see FIG. 3).

The shift register 55, the latch circuit 56, the level shifter 57, the switching unit 58, the mode-bit signal generating unit 120 and the controlling part 6 are adapted to function as a micro-vibrating-signal supplying (generating) unit (a micro-vibrating controlling unit). That is, they can supply a micro-vibrating operating signal, which is formed by fusing a non-recording common micro-vibrating signal or a pre-recording common micro-vibrating signal from the micro-vibrating-signal generating part 12 and a micro-vibrating mode signal (described below) dependent on the mode-bit signal, to the recording head 8 (piezoelectric vibrating members 35). Alternatively, they can generate a mid-recording micro-vibrating signal from a jetting operating signal, and output (supply) the signal to the recording head 8.

In addition, the shift register 55, the latch circuit 56, the level shifter 57, the switching unit 58 and the controlling part 6 are adapted to function as operating-pulse supplying means. That is, they can generate an operating pulse (operating-pulse signal) from a jetting operating signal from the operating-signal generating part 9, and output (supply) the operating pulse to the piezoelectric vibrating members 35 of the recording head 8.

Then, a controlling operation for jetting a drop of ink is explained.

At first, a controlling operation for causing the meniscus 52 to minutely vibrate with the non-recording common micro-vibrating signal or the pre-recording common micro-vibrating signal from the micro-vibrating-signal generating part 12 in order to stir the ink is explained.

In the case, the controlling part 6 transfers in a serial manner and sets in turn respective upper bit-data of the units of the mode-bit signal from the outputting buffer 4C to the shift register devices 55A to 55N respectively, suitably synchronously with the clock signal (CK) from the oscillating circuit 7. When the upper bit-data of all the units for all the nozzles 51 are set in the shift register devices 55A to 55N, the controlling part 6 outputs latch signals (LAT) to the latch circuit 56 i.e. the latch devices 56A to 56N at a suitable timing. Owing to the latch signals, the latch devices 56A to 56N latch the bit-data set in the shift register devices 55A to 55N, respectively. The latched bit-data are supplied to the level shifter 57 i.e. the level shifter devices 57A to 57N, respectively. The level shifter 57 is adapted to function as a voltage amplifier.

For example, when the set datum (bit-data) is 1, each of the level shifter devices 57A to 57N (a micro-vibrating-mode-signal generating unit) raises the datum (bit-data) to a voltage of several decade volt that can drive the switching unit 58 to make a micro-vibrating mode signal (see FIG. 3). The raised datum (the micro-vibrating mode signal) is applied to the switching unit 58 i.e. each of the switching devices 58A to 58N (a signal fusing part). Each of the switching devices 58A to 58N is closed (connected) by the micro-vibrating mode signal. On the other hand, when the set datum (bit-data) is 0, each of the level shifter devices 57A to 57N does not raise the datum.

The non-recording common micro-vibrating signal or the pre-recording common micro-vibrating signal from the micro-vibrating-signal generating part 12 is applied to each of the switching devices 58A to 58N. When each of the switching devices 58A to 58N is closed, the non-recording common micro-vibrating signal or the pre-recording common micro-vibrating signal is supplied to each of the piezoelectric vibrating members 35A to 35N that are connected to the switching devices 58A to 58N.

After the non-recording common micro-vibrating signal or the pre-recording common micro-vibrating signal has been supplied to the piezoelectric vibrating member based on the upper bit-data, the controlling part 6 transfers in a serial manner and sets in turn respective lower bit-data of the units of the mode-bit signal to the shift register devices 55A to 55N respectively. When the lower bit-data are set in the shift register devices 55A to 55N, the controlling part 6 outputs latch signals (LAT) to the latch circuit 56 to latch the set bit-data, and the non-recording common micro-vibrating signal or the pre-recording common micro-vibrating signal is supplied to each of the piezoelectric vibrating members 35A to 35N, respectively.

When the micro-vibrating signal is supplied to the piezoelectric vibrating members 35, the pressure generating chambers 36 repeat to minutely expand and contract. Thus, as shown in FIG. 5B, the meniscus 52 can be minutely vibrated between a position of a jetting side and a position of a contracting side nearer to the pressure chamber 36. In FIG. 5B, the position of the jetting side is designated by a broken line, and the position of the contracting side is designated by a real line. Owing to the vibration of the meniscus 52, the ink at the opening of the nozzle can be stirred.

As described above, the printer can control whether to supply the non-recording common micro-vibrating signal or the pre-recording common micro-vibrating signal to the piezoelectric vibrating members 35 based on the mode-bit signal. That is, if a bit-data of the mode-bit signal is "1", a micro-vibrating operating signal being an AND signal of a rectangular-pulse-shaped micro-vibrating mode signal formed by the latched and raised bit-data and the non-recording common micro-vibrating signal or the pre-recording common micro-vibrating signal may be supplied to the corresponding piezoelectric vibrating member 35. If a bit-data of the mode-bit signal is "0", the non-recording common micro-vibrating signal or the pre-recording common micro-vibrating signal may not be supplied to the corresponding piezoelectric vibrating member 35. Herein, if a bit-data is "0", the piezoelectric vibrating member 35 holds previous electric charges i.e. a previous voltage.

Thus, a plurality of micro-vibrating operating signals can be made selectively from one common micro-vibrating signal, when the common micro-vibrating signal is divided into some sections with respect to time and each bit-data of the unit of mode-bit signal is set correspondingly to each of the divided sections. The generated micro-vibrating operating signals may be supplied to the piezoelectric vibrating members 35.

In this example, as shown in FIG. 3, the common micro-vibrating signal is formed by the periodical signal serially including the trapezoidal pulses 111 switched between the lowermost potential and the middle potential. The mode-bit signal "01" or "10", each bit of which corresponds to each trapezoidal pulse 111, is adapted to be generated depending on each class of nozzles A or B. Thus, the trapezoidal pulses 111 are supplied to the piezoelectric vibrating members 35 corresponding to the respective classes of nozzles A and B in turn.

Thus, the menisci of the nozzles 51 of the respective classes A and B are respectively caused to minutely vibrate at a frequency of 10.8 kHz. That is, necessary and sufficient non-recording micro-vibrating control and pre-recording micro-vibrating control can be achieved. In addition, it is prevented that the nozzles may drip with the ink so that the ink may not be jetted from the nozzles accurately but deflected. On the other hand, micro-vibrating operations of the respective classes of nozzles are carried out at the respective phases different by ½ of the period. Thus, the frequency of noise is 21.6 kHz, which is out of the human hearable frequency band. That is, the substantial volume of the noise may be remarkably reduced. In addition, the number of the piezoelectric vibrating members 35 caused to vibrate at the same time is reduced by half, which contributes to reducing the volume of the noise.

The pattern of classes into which the nozzles are classified is not limited to the embodiment, but may be determined suitably.

Figure 8:
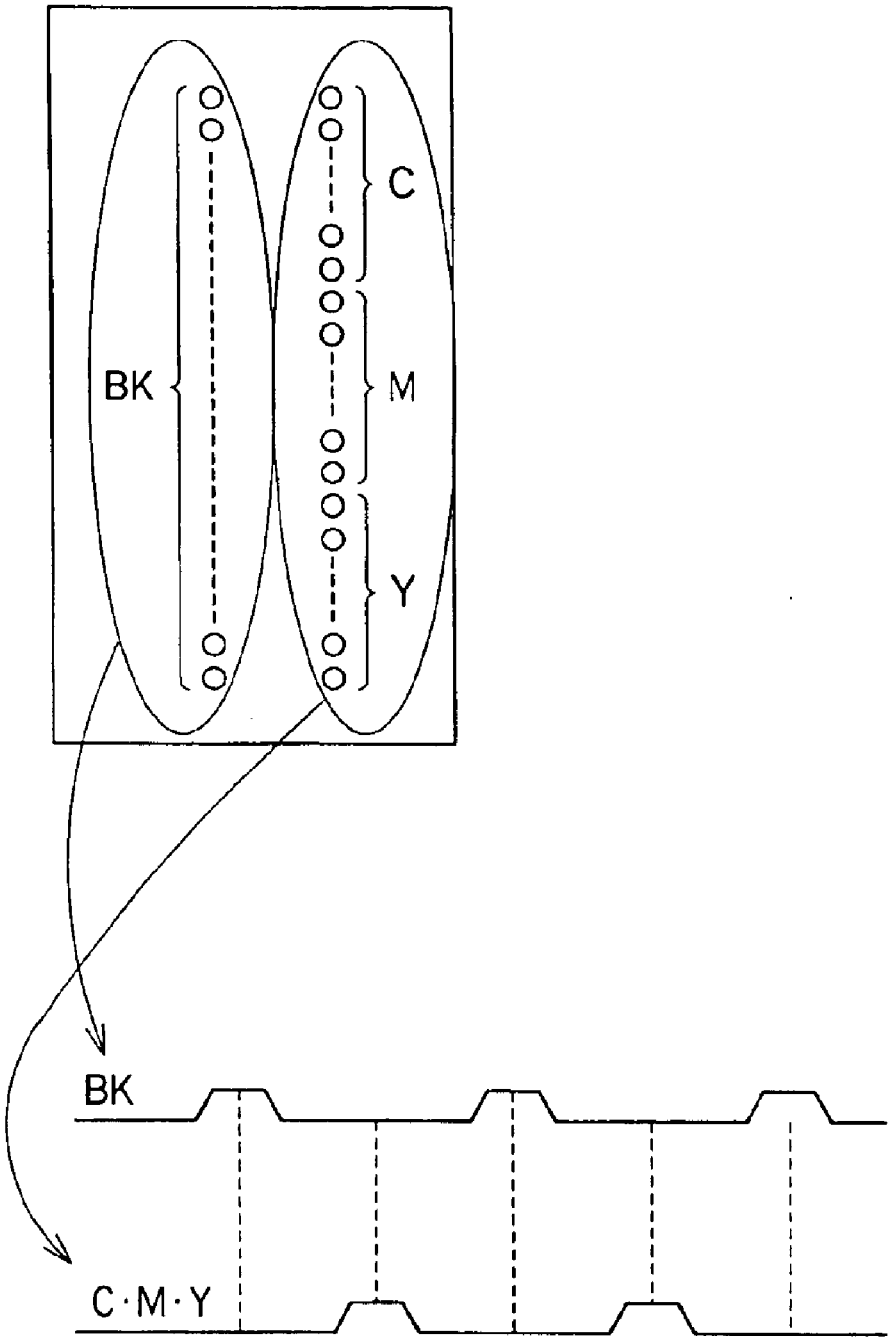
FIG. 8 is a drawing showing an example of nozzles classified into classes and respective micro-vibrating operating signals supplied to the nozzles classified into the respective classes.
Figure 9:
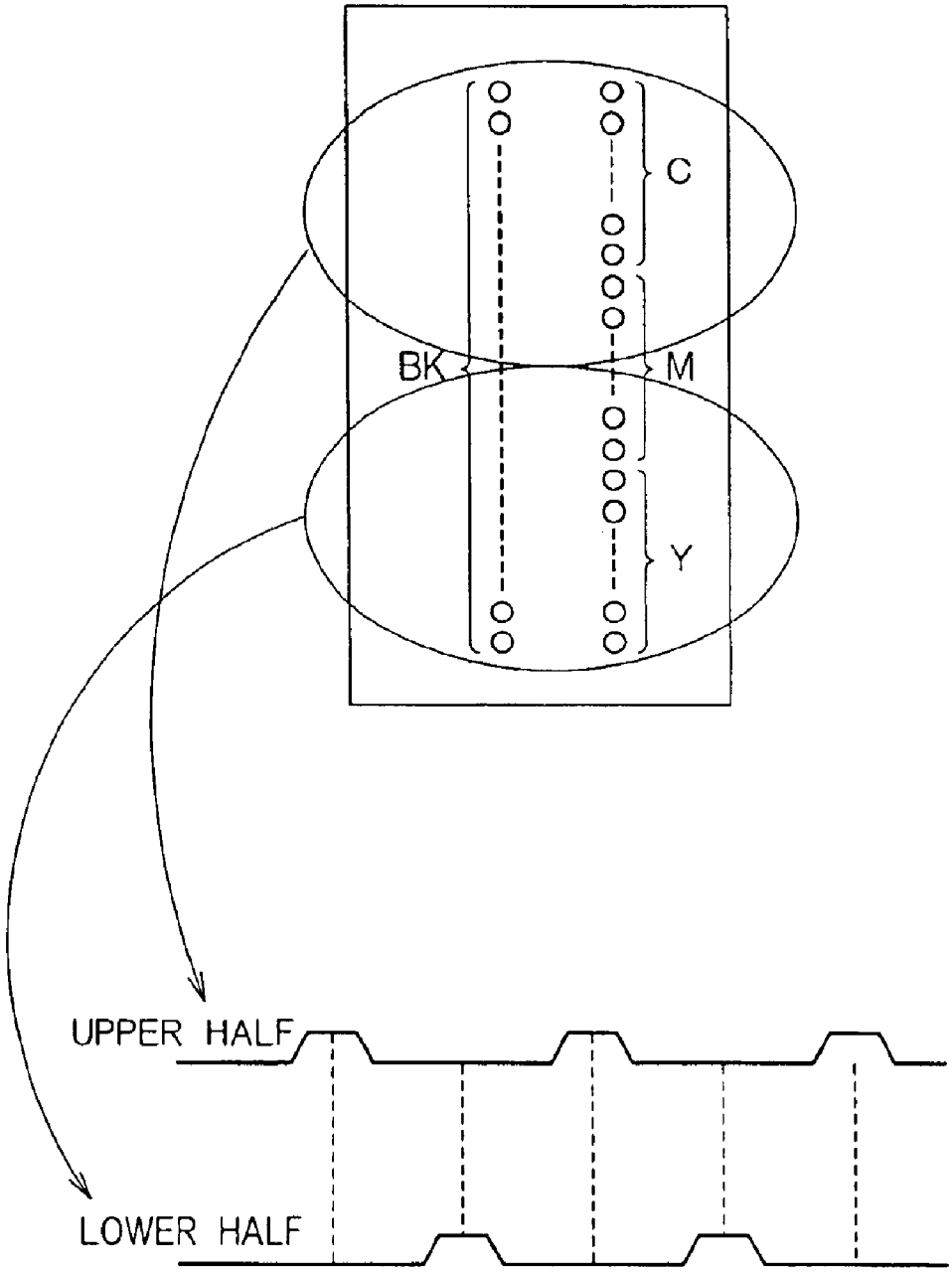
FIG. 9 is a drawing showing another example of nozzles classified into classes and respective micro-vibrating operating signals supplied to the nozzles classified into the respective classes.

For example, as shown in FIG. 8, in a case of a four-color recording head having two rows of nozzles, each row of nozzles may be classified (selected) into each class of nozzles. That is, nozzles for jetting BK (black) ink may be selected as a first class of nozzles, and the other nozzles for jetting color inks of Y (yellow), M (magenta) and C (cyan) may be selected as a second class of nozzles. Alternatively, as shown in FIG. 9, the upper half of the nozzles (for example, if one row of nozzles consists of 180 nozzles, upper 90 nozzles) may be selected as a first class of nozzles, and the lower half of the nozzles may be selected as a second class of nozzles.

Figure 10:
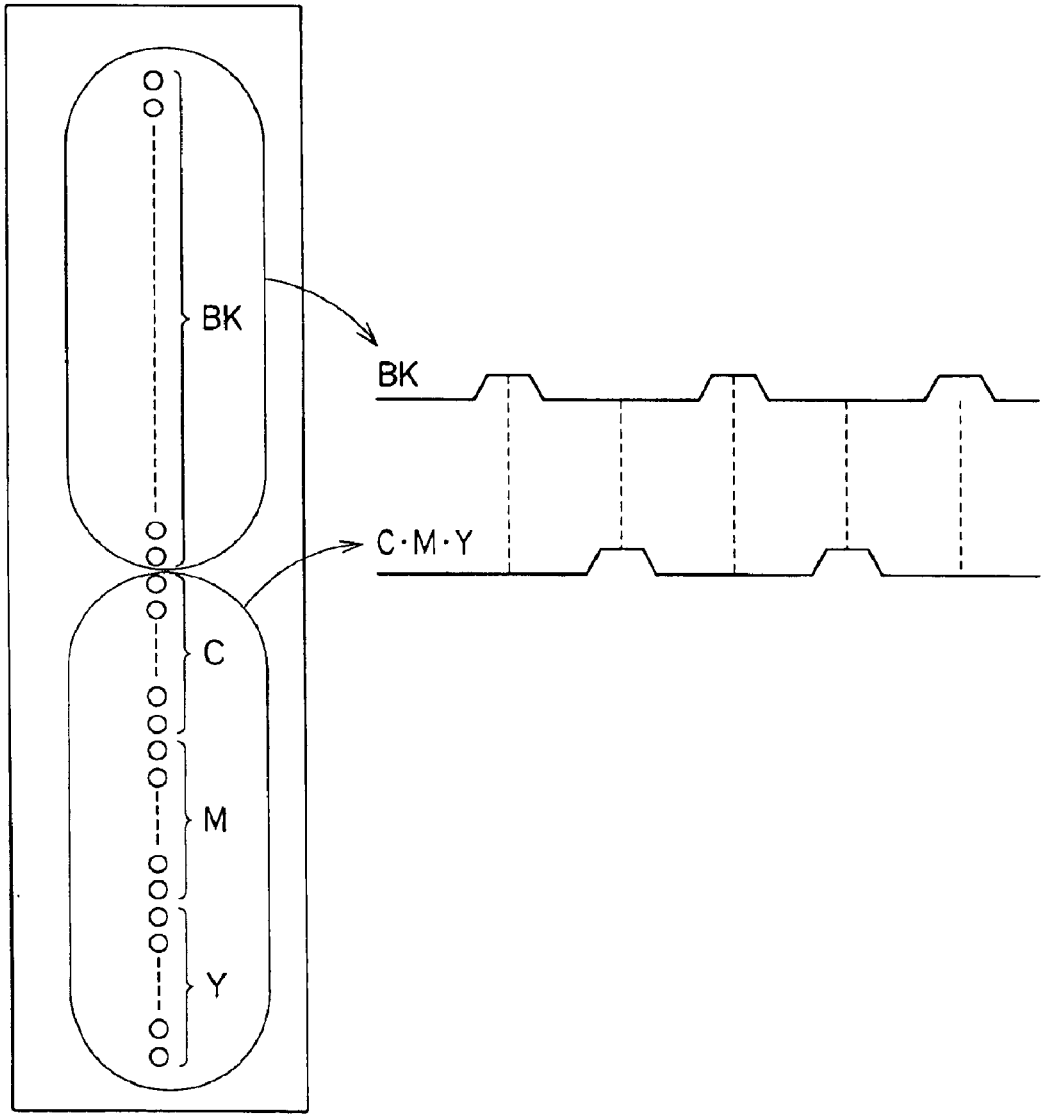
FIG. 10 is a drawing showing another example of nozzles classified into classes and respective micro-vibrating operating signals supplied to the nozzles classified into the respective classes.

Alternatively, as shown in FIG. 10, in a case of a four-color recording head having one row of nozzles, nozzles for jetting BK (black) ink may be selected as a first class of nozzles, and the other nozzles for jetting color inks of Y (yellow), M (magenta) and C (cyan) may be selected as a second class of nozzles.

Figure 11:
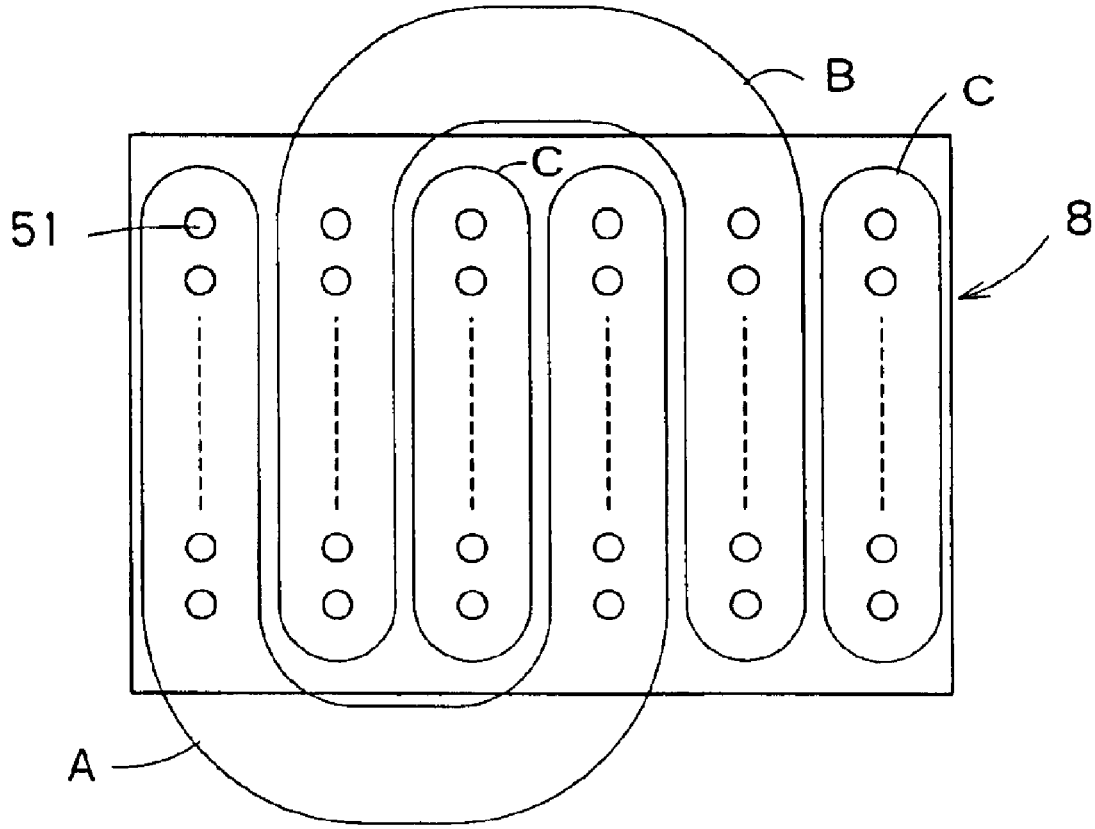
FIG. 11 is a drawing showing another example of nozzles classified into classes.
Figure 12:
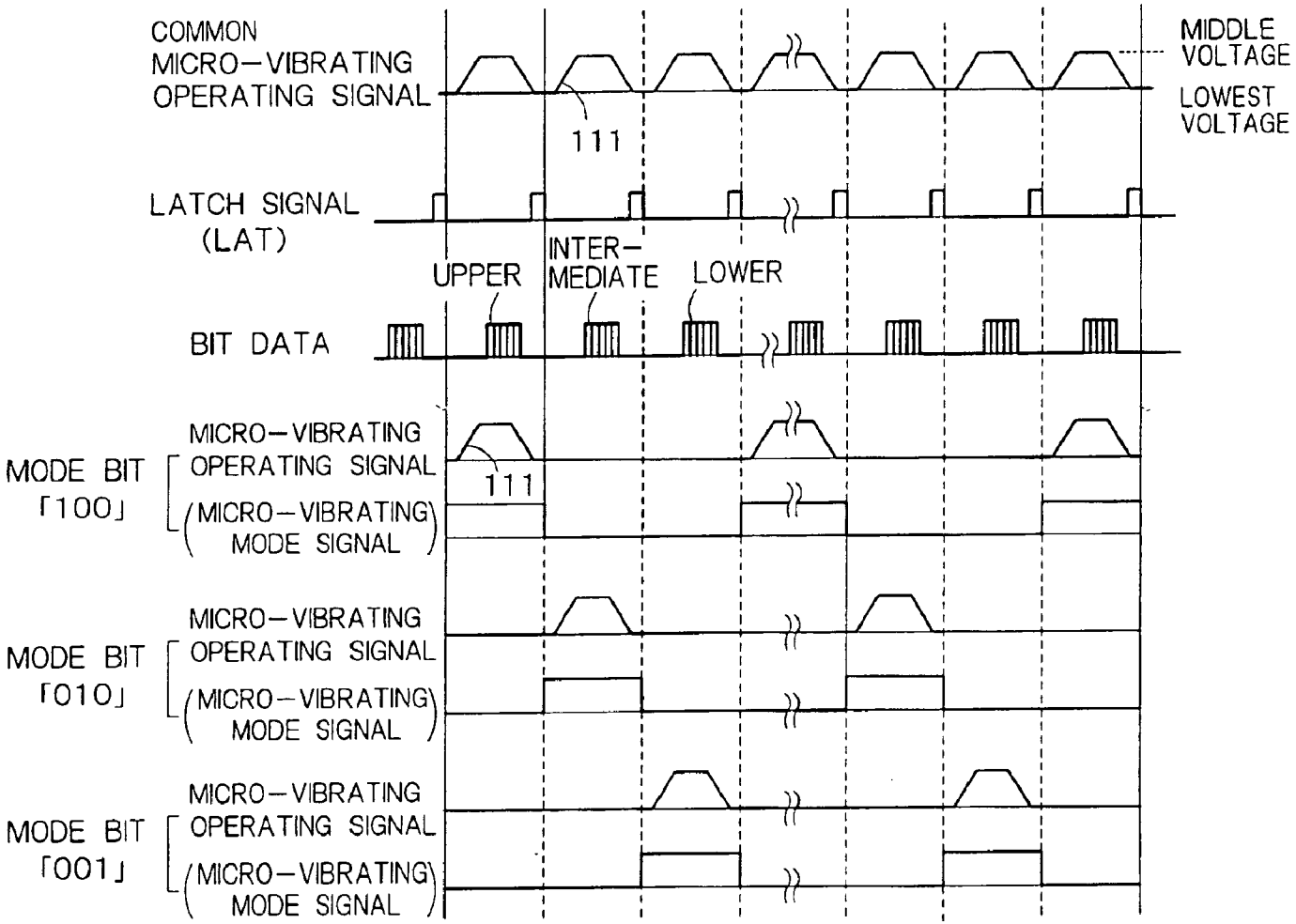
FIG. 12 is an explanatory view of another example of micro-vibrating operating signals.

The number of classes into which the nozzles are classified may be not less than three. For example, as shown in FIG. 11, the plurality of nozzles 51 may be classified into three classes of nozzles A, B and C, each of which includes every third rows of nozzles. In the case, as shown in FIG. 12, bit-data consists of three bits correspondingly to the classes of nozzles A, B and C, and the frequency at which the pulse 111 appears may be 32.4 kHz. The mode-bit signal is formed by digital data consisting of three bits of 100, 010 or 001, each of which corresponds to each of the classes A, B and C, so that three mode-instructions are achieved. In the case, micro-vibrating operations of the respective classes of nozzles are carried out at the respective phases different by ⅓ of the period. Thus, the substantial frequency of noise is 32.4 kHz.

Figure 13A:
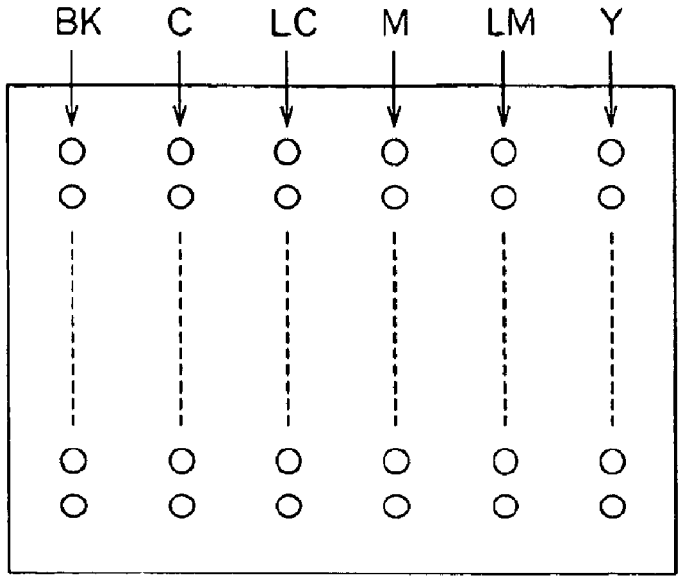
FIGS. 13A and 13B are drawings showing another example of nozzles classified into classes and respective micro-vibrating operating signals supplied to the nozzles classified into the respective classes.
Figure 13B:
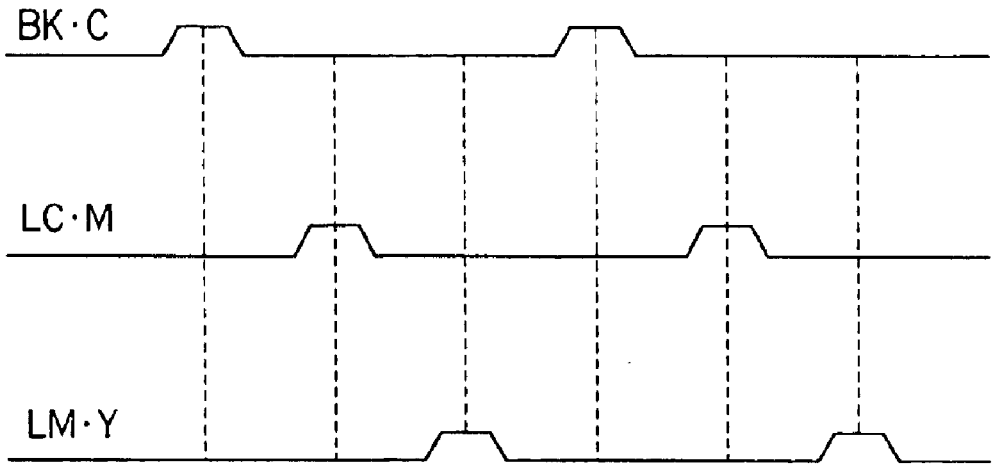

As a concrete example, as shown in FIG. 13, in a case of a six-color recording head having six rows of nozzles, nozzles for jetting BK (black) ink and C (cyan) ink may be selected as a first class of nozzles, nozzles for jetting LC (light cyan) ink and M (magenta) ink may be selected as a second class of nozzles, and the other nozzles for jetting LM (light magenta) ink and Y (yellow) ink may be selected as a third class of nozzles.

Next, the operating pulse is supplied to the piezoelectric vibrating members 35 as follows. Herein, each of printing data forming the dot-pattern-data corresponds to one dot and consists of three bits.

In the case, the controlling part 6 transfers in a serial manner and sets in turn data of respective uppermost bits of the units of the printing data (SI) from the outputting buffer 4C to the shift register devices 55A to 55N respectively, synchronously with the clock signal (CK) from the oscillating circuit 7. When the uppermost data of all the units for all the nozzles 51 are set in the shift register devices 55A to 55N, the controlling part 6 outputs latch signals (LAT) to the latch circuit 56 i.e. the latch devices 56A to 56N at a predetermined timing. Owing to the latch signals, the latch devices 56A to 56N latch the data set in the shift register devices 55A to 55N respectively. The latched data are supplied to the level shifter 57 i.e. the level shifter devices 57A to 57N respectively. The level shifter 57 is adapted to function as a voltage amplifier.

For example, when the set datum is 1, each of the level shifter devices 57A to 57N (a main-mode-signal generating unit) raises the datum to a voltage of several decade volt that can drive the switching unit 58, to make a main mode signal (see FIG. 2). The raised datum (the main mode signal) is applied to the switching unit 58 i.e. each of the switching devices 58A to 58N. Each of the switching devices 58A to 58N is closed (connected) by the raised datum. On the other hand, when the set datum is 0, each of the level shifter devices 57A to 57N does not raise the datum.

A jetting operating signal (COM) from the main-signal generating part 11 is applied to each of the switching devices 58A to 58N. When each of the switching devices 58A to 58N is closed, the jetting operating signal is supplied to each of the piezoelectric vibrating members 35A to 35N that are connected to the switching devices 58A to 58N.

After the jetting operating signal has been supplied to the piezoelectric vibrating members based on the uppermost bits, the controlling part 6 transfers in a serial manner and sets data of respective secondly uppermost bits of the units of the printing data (SI) to the shift register devices 55A to 55N respectively. When the second data are set in the shift register devices 55A to 55N, the controlling part 6 outputs latch signals (LAT) to the latch circuit 56 to latch the set data, and the jetting operating signal is supplied to each of the piezoelectric vibrating members 35A to 35N respectively. Thereafter, the similar operations are repeated for from the thirdly uppermost bits to the lowermost bits in the order.

As described above, the printer can control whether to supply the jetting operating signal to the piezoelectric vibrating members 35 based on the printing data. That is, if the printing datum is "1", an operating pulse signal being an AND signal of a rectangular-pulse-shaped main mode signal formed by the latched and raised printing-data and the jetting operating signal may be supplied to the corresponding piezoelectric vibrating member 35. If the printing datum is "0", the jetting operating signal may not be supplied to the corresponding piezoelectric vibrating member 35. Herein, if a printing datum is "0", the piezoelectric vibrating member 35 holds previous electric charges i.e. a previous voltage.

Thus, a plurality of operating pulses and a mid-recording micro-vibrating signal can be made selectively from one jetting operating signal, when the jetting operating signal is divided into some sections with respect to time and each of the bits of the units of the printing data is set correspondingly to each of the sections of the jetting operating signal. The generated operating pulse or mid-recording micro-vibrating signal may be supplied to each of the piezoelectric vibrating members 35. Thus, a meniscus 52 of ink in a nozzle not in a recording operation can be suitably vibrated while another nozzle is in the recording operation, in order to sufficiently stir the ink in the former nozzle and to prevent that the former nozzle may drip with the ink so that the ink may not be jetted from the former nozzle accurately but deflected. In addition, the plurality of operating pulses corresponding to a plurality of volumes of ink (dot diameters) can be supplied to each of the piezoelectric vibrating members 35 of the recording head 8.

For example, as shown in FIG. 2, the jetting operating signal is divided into a first pulse section 61, a second pulse section 62 and a third pulse section 63. A mid-printing micro-vibrating signal is generated by the first pulse section 61. A small-dot operating pulse is generated by the second pulse section 62. A large-dot operating pulse is generated by the third pulse section 63.

The small-dot operating pulse is an operating pulse that can cause a small-sized inkdrop forming a small-sized dot to be jetted. The large-dot operating pulse is an operating pulse that can cause a large-sized inkdrop forming a large-sized dot to be jetted. The mid-recording micro-vibrating pulse (signal) is an operating pulse that can cause the meniscus 52 of the ink in the nozzle 51 not in the recording operation to minutely vibrate.

When the mid-recording micro-vibrating signal is supplied to the piezoelectric vibrating members 35, the pressure generating chambers 36 repeat to minutely expand and contract. Thus, as shown in FIG. 5B, the meniscus 52 can be minutely vibrated between a position of a jetting side and a position of a contracting side nearer to the pressure chamber 36. In FIG. 5B, the position of the jetting side is designated by the broken line, and the position of the contracting side is designated by the real line. Owing to the vibration of the meniscus 52, the ink at the opening of the nozzle can be stirred.

In the embodiment, the printing data consist of data of three bits D1, D2 and D3. When D1=0, D2=1 and D3=0 are set, the small-dot operating pulse is adapted to be generated. When D1=0, D2=0 and D3=1 are set, the large-dot operating pulse is adapted to be generated. When D1=1, D2=0 and D3=0 are set, the mid-recording micro-vibrating pulse is adapted to be generated. When D1=0, D2=0 and D3=0 are set, even the mid-recording micro-vibrating control is not carried out.

Then, a scanning operation including a recording operation of the printer described above is explained in more detail. In the printer, the menisci 52 can minutely vibrate to prevent the viscosity of ink from increasing in cooperation with a main scanning of the recording head 8, i.e., in cooperation with the scanning operation for a line. In more detail, the menisci 52 can minutely vibrate while the recording head 8 (carriage 21) is being accelerated, just before the starting of the recording operation, and during the recording operation.

Figure 14:
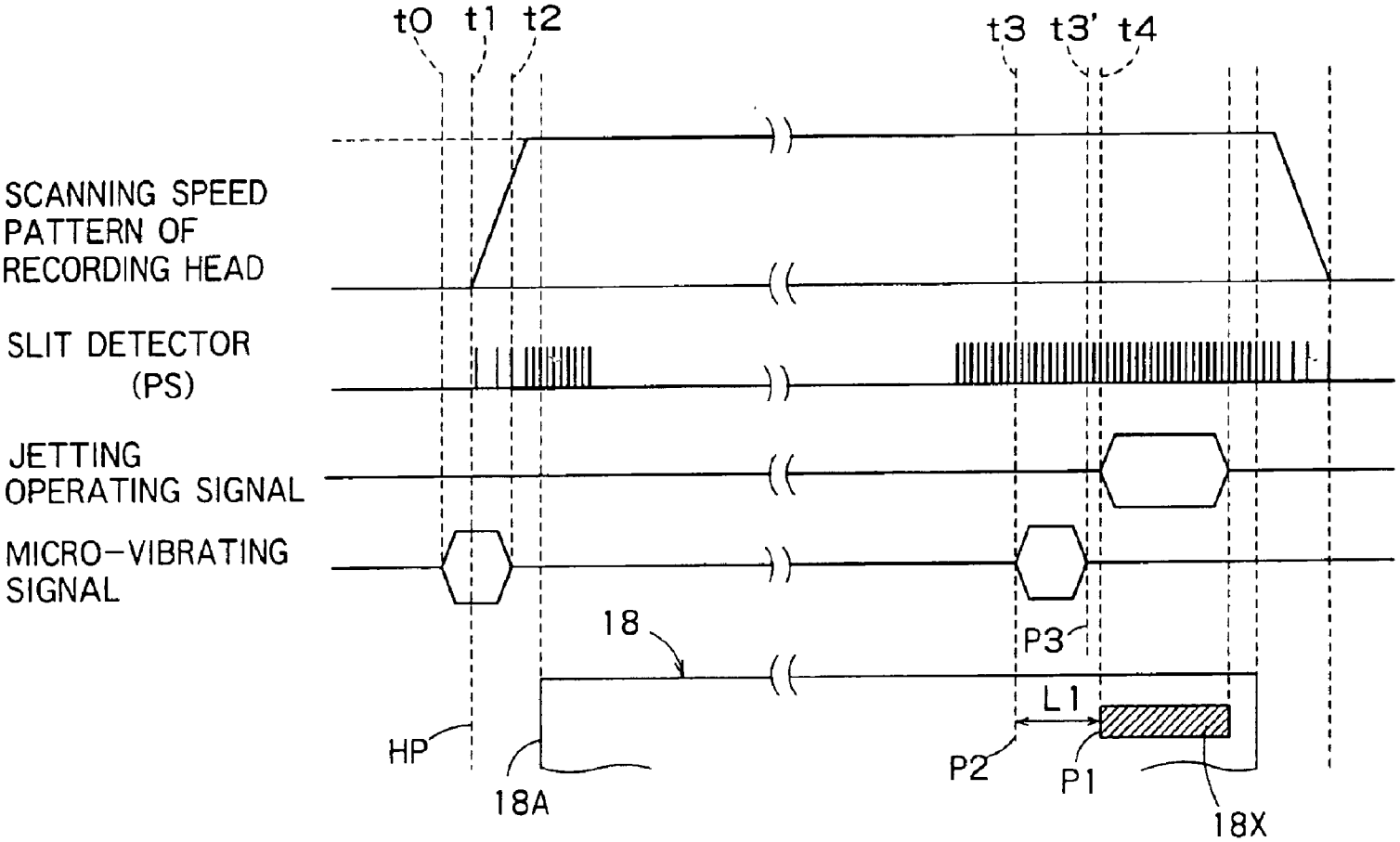
FIG. 14 is a timing chart for explaining a recording operation for one line.

As shown in FIG. 14, in the case, an image 18X is recorded in an area opposed to the home position HP in the recording paper 18, that is, in the latter half of a line.

Figure 16A:
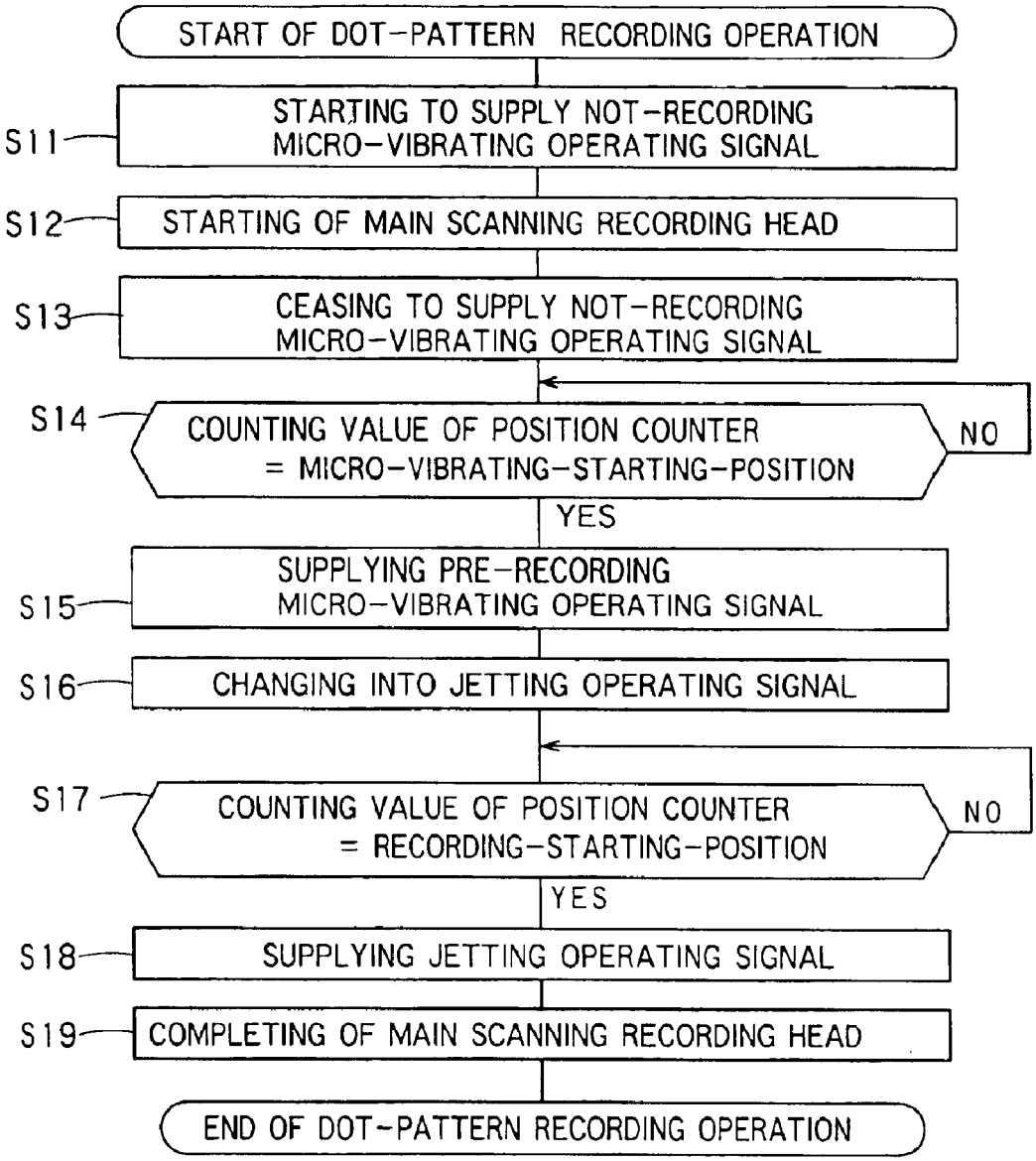
FIG. 16A is a flowchart for explaining a dot-pattern recording operation.
Figure 16B:
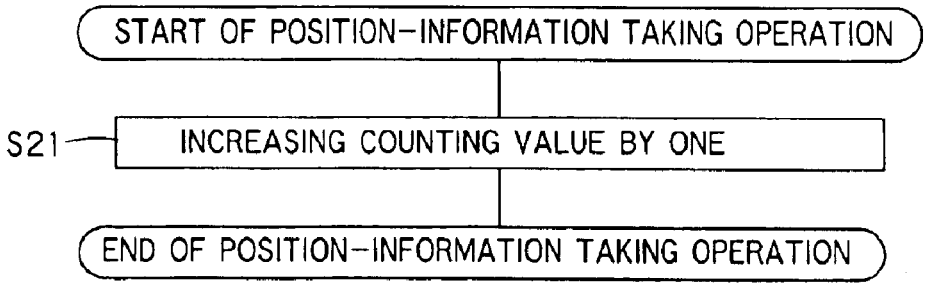
FIG. 16B is a flowchart for explaining a position-information taking operation.

FIG. 14 is a timing chart for explaining the scanning operation including the recording operation for the line. In FIG. 14, there are also shown the recording paper 18, and a relationship between a recording area by the recording head 8 and time. FIG. 14 is a flowchart for explaining a dot-pattern developing operation. FIG. 16A is a flowchart for explaining a dot-pattern recording operation. FIG. 16B is a flowchart for explaining a position-information taking operation that may be carried out interrupting the dot-pattern recording operation.

The recording operation is mainly divided into the dot-pattern developing operation for generating dot-pattern-data for the line from the middle-code-data, and the dot-pattern recording operation for recording (jetting ink) on the recording paper 18 based on the developed dot-pattern-data.

Each of the dot-pattern developing operation and the dot-pattern recording operation is explained as below.

Figure 15:
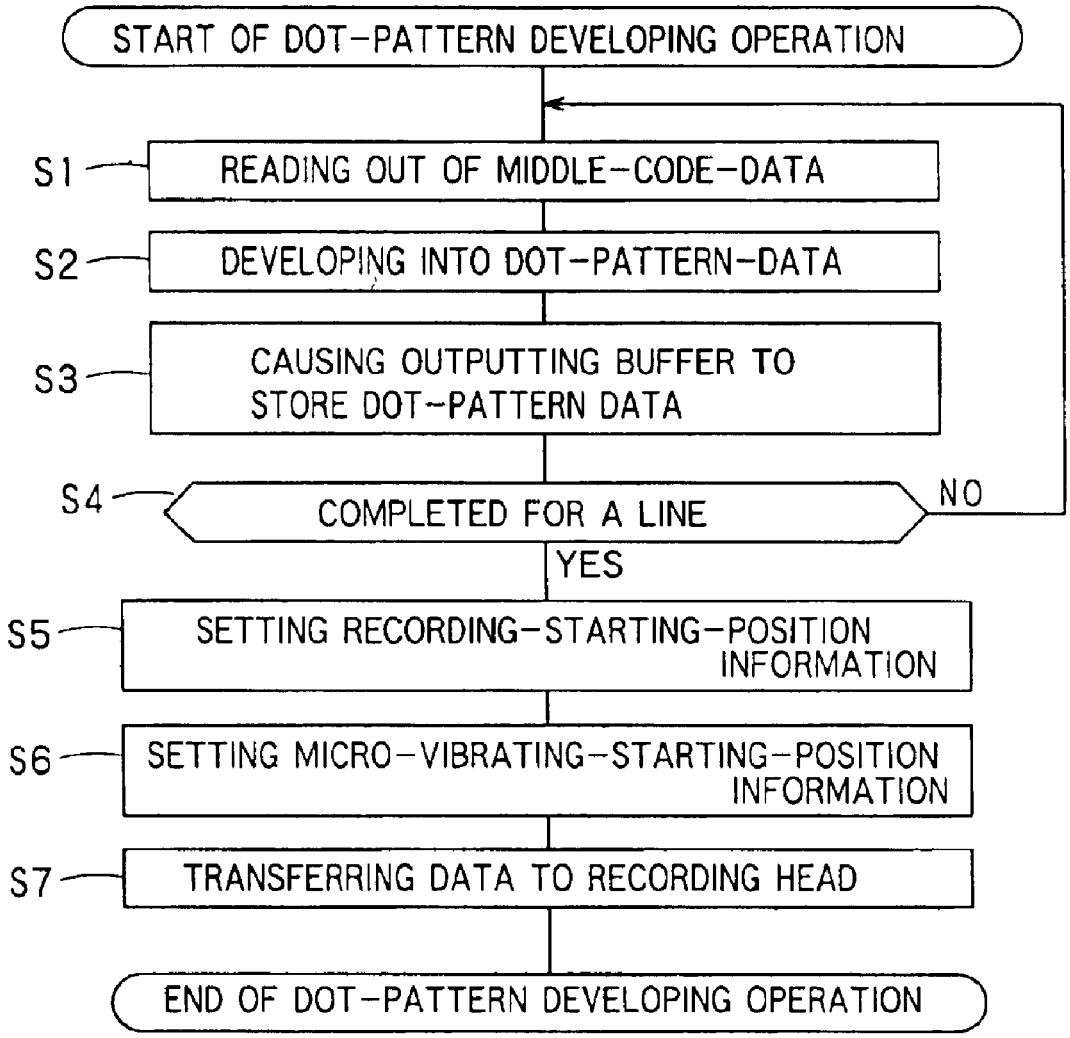
FIG. 15 is a flowchart for explaining a dot-pattern developing operation.

In the dot-pattern developing operation shown in FIG. 15, the controlling part 6 functions as a dot-pattern-data generating unit to generate the dot-pattern-data for the line. That is, the controlling part 6 reads out middle-code-data stored in the middle buffer 4B (S1), develops the middle-code-data into a part of the dot-pattern-data based on the font data and the graphic functions or the like stored in the ROM 5 (S2), and causes the outputting buffer 4C to store the part of the developed dot-pattern-data (S3). Then, the developing operation is repeated until all the parts of the dot-pattern-data for the line are stored in the outputting buffer 4C (S4).

When the dot-pattern-data corresponding to the line are stored in the outputting buffer 4C, the controlling part 6 functions as a recording-starting-position-information setting unit to set recording-starting-position information that represents a position where a nozzle should start to record in the line, that is, where a first ink drop should be jetted from the nozzle during the main scanning (S5). In FIG. 14, the recording-starting-position is designated by a reference sign P1.

In the embodiment, the recording-starting-position information is set correspondingly to the counting value about the slits 28 of the linear encoder 27, that is, the counting value of pulses PS outputted from the slit detector 29.

Then, the controlling part 6 functions as a micro-vibrating-starting-position-information setting unit to set micro-vibrating-starting-position information that represents a position where the micro-vibrating unit should start to cause the ink to minutely vibrate, for example just before starting the recording operation (S6). For example, the micro-vibrating-starting-position is set at a position P2 back to the home position HP from the recording-starting-position P1 by a distance L1 that is necessary for the menisci to keep minutely vibrating and to settle down thereafter. That is, the setting of the micro-vibrating-starting-position P2 is carried out based on the recording-starting-position information that has been set previously. Then, a counting value obtained by subtracting a counting value corresponding to the predetermined distance L1 from a counting value corresponding to the recording-starting-position P1 is set as a counting value corresponding to the micro-vibrating-starting-position P2.

When the micro-vibrating-starting-position information is set, the controlling part 6 transfers the developed dot-pattern-data to the recording head 8 (S7). On transferring the developed dot-pattern-data, a scanning operation starts for the line, that is, the recording head 8 starts scanning in the main scanning direction. In addition, a micro-vibrating controlling operation that cause the menisci 52 to minutely vibrate to stir the ink in the nozzles 51 is carried out in cooperation with the main scanning of the recording head 8. During the micro-vibrating control ling-operation, the controlling part 6 functions as a micro-vibrating controlling unit.

After transferring the dot-pattern-data, the controlling part 6 carries out the dot-pattern recording operation. In the dot-pattern recording operation, the controlling part 6 functions as a not-recording micro-vibrating controlling unit (one kind of the micro-vibrating controlling unit) to stir the ink while the carriage 21 is being accelerated. That is, on transferring the dot-pattern-data, the controlling part 6 supplies a not-recording common micro-vibrating signal from the micro-vibrating-signal generating part 12 to the piezoelectric vibrating members 35 of the recording head 8.

As shown in FIGS. 14 and 16A, the controlling part 6 starts to supply the not-recording common micro-vibrating signal (S11, t0), and then starts the scanning of the recording head 8 (S12, t1). In the case, the controlling part 6 ceases to supply the not-recording common micro-vibrating signal at a timing just before a speed of the recording head 8 ceases to increase but becomes constant (S13, t2).

During the series of steps, the controlling part 6 outputs such a controlling signal to the choosing part 13 that the non-recording common micro-vibrating signal from the micro-vibrating-signal generating part 12 is allowed to be supplied to the piezoelectric vibrating members 35. Then, the controlling part 6 sets the respective bit-data of each of the mode bit signals in the shift register 55, and outputs the latch signals to the latch circuit 56 in order to generate each micro-vibrating signal corresponding to each classified class of nozzles. Each generated micro-vibrating signal is supplied to the piezoelectric vibrating members 35 (see FIG. 3). Then, the controlling part 6 supplies an operating pulse to the pulse motor 25 to move the carriage 21 in the main scanning direction. Thus, the recording head 8 starts scanning. If a stopping timing for the non-recording micro-vibrating signal is judged, the non-recording common micro-vibrating signal stops being supplied from the micro-vibrating-signal generating unit 12. Thus, the non-recording micro-vibrating operations are stopped.

During the scanning of the recording head 8, the slit detector 29 mounted on the carriage 21 detects the slits 28 of the linear encoder 27, and outputs pulse-like detecting signals that are shown with a reference sign PS in FIG. 14. The controlling part 6 watches the detecting signals and carries out the position-information taking operation whenever each of the detecting signals is received. The position-information taking operation is carried out interrupting the dot-pattern recording operation. In the position-information taking operation, the position counter is updated (S21). In more detail, the counting value of the position counter that represents head-position information increases by one, based on each of the detecting signals from the slit detector 29. After the counting value has increased by one, the dot-pattern-recording operation is resumed. Herein, the counting value of the position counter may be reset when the scanning of the recording head 8 for the line is completed or when the recording head 8 is returned at the standard position.

During the scanning of the recording head 8, the controlling part 6 also functions as a pre-recording micro-vibrating-starting-timing judging unit, that is, judges a micro-vibrating-starting timing just before the recording operation (S14). In the embodiment, the controlling part 6 can judge the pre-recording micro-vibrating-starting timing by comparing the counting value of the position counter with the counting value corresponding to the micro-vibrating-starting-position P2 (micro-vibrating-starting-position information) because the controlling part 6 watches the counting value of the position counter (t3).

When the controlling part 6 judges that it is the pre-recording micro-vibrating-starting timing, the controlling part 6 functions as a pre-recording micro-vibrating controlling unit (one kind of the micro-vibrating controlling unit) to supply a pre-recording common micro-vibrating signal to the piezoelectric vibrating members 35 (S15).

That is, the controlling part 6 outputs such a controlling signal to the choosing part 13 that the pre-recording common micro-vibrating signal from the micro-vibrating-signal generating part 12 is allowed to be supplied to the piezoelectric vibrating members 35. Then, the controlling part 6 sets the respective bit-data of each of the mode bit signals in the shift register 55, and outputs the latch signals to the latch circuit 56 in order to generate each micro-vibrating signal corresponding to each classified class of nozzles. Each generated micro-vibrating signal is supplied to the piezoelectric vibrating members 35 (see FIG. 3). If a predetermined stopping timing (t3'), which is described below, is judged, the pre-recording common micro-vibrating signal stops being supplied from the micro-vibrating-signal generating unit 12. Thus, the pre-recording micro-vibrating operations are stopped.

While the pre-recording micro-vibrating signal is supplied, the menisci 52 minutely vibrate to stir the ink. Thus, the viscosity of the ink in the nozzles may be returned to a normal level even when the viscosity of the ink at the openings in the nozzles has increased as the solvent of the ink has evaporated.

The predetermined stopping timing (t3') can be judged by using a timer for measuring a time (t3'–t3) for which the pre-recording common micro-vibrating signal is being supplied. In the case, the predetermined stopping timing (t3') can be judged when the pre-recording common micro-vibrating signal is supplied for the predetermined time (t3'–t3), that is, when the timer measures the predetermined time (t3'–t3). Alternatively, the predetermined stopping timing (t3') can be judged by comparing the counting value of the position counter with a predetermined counting value P3.

Then, after ceasing to supply the pre-recording common micro-vibrating signal, the controlling part 6 outputs such a controlling signal to the choosing part 13 of the operating-signal generating part 9 that the jetting operating signal from the main signal generating part 11 is allowed to be supplied to the piezoelectric vibrating members 35 (S16).

After outputting the controlling signal, the controlling part 6 also functions as a recording-starting-timing judging unit (means), that is, judges a recording-starting timing (S17). In the embodiment, the controlling part 6 can judge the recording-starting timing by comparing the counting value of the position counter with the counting value corresponding to the recording-starting-position P1 because the controlling part 6 watches the counting value of the position counter (t4).

When the controlling part 6 judges that it is the recording-starting timing, the controlling part 6 supplies the jetting operating signal to the piezoelectric vibrating members 35 to record an image (jet the ink) on the recording paper 18 (S18). In the case, as shown in FIG. 2, one of the small-dot operating pulse, the large-dot operating pulse and the mid-recording micro-vibrating signal is supplied to each of the piezoelectric vibrating members 35A to 35N, based on the dot-pattern-data. Then, the ink drop jetted from the nozzle forms a small dot or a large dot correspondingly to the supplied operating pulse.

In addition, the mid-recording micro-vibrating signal is supplied for a nozzle or nozzles 51 which do not jet ink, so that a meniscus or menisci of the ink in the nozzle or the nozzles 51 can minutely vibrate to stir the ink.

According to the above control, the ink drop can be jetted in a state wherein the viscosity of the ink is returned to a normal level by the micro-vibrating operation of the meniscus 52 just before the jetting. Thus, a first ink drop of a line can be jetted accurately in a predetermined direction. Therefore, the deterioration of the quality of the recorded (printed) image is effectively prevented especially at the position where the printing operation starts even when the volume of the jetted ink is so small that the viscosity of the ink is liable to increase.

Especially when the recording paper is large-sized, the ink drop may not be jetted for such a longer time that the viscosity of the ink is liable to increase. However, even in the case, the above control can certainly prevent the deterioration of the quality of the printed image at the position where the printing operation starts.

After the scanning operation for the line is completed, the pulse motor 25 is stopped (S19). Then, the recording head 8 is moved toward the home position HP, and is positioned at the standard position. Then, the similar scanning operation including the recording operation is repeated for the next line.

In the above embodiment, the menisci 52 can minutely vibrate to stir the ink both of while the carriage 21 is being accelerated and for a predetermined time just before the recording operation. However, the pre-recording micro-vibrating just before the recording operation may be carried out only when the recording operation starts at a position in a predetermined area, for example in the latter half of a line. That is, the controlling part 6 (micro-vibrating controlling unit) may carry out the pre-recording micro-vibrating operation only when a recording-starting position represented by the recording-starting-position information is in the latter area with respect to a predetermined position. In the case as well, the viscosity of the ink is sufficiently prevented from increasing, because the ink may be sufficiently stirred by only the not-recording micro-vibrating operation (micro-vibrating operation during the accelerating time) when the recording operation starts at a position in the former area with respect to the predetermined position.

In addition, in general, the printer is arranged in an environment whose temperature is in a wide range of from several to forty and several centigrade. There is a difference in the viscosity of the ink between at a higher temperature and at a lower temperature, even if the ink is the same kind. That is, the viscosity of the ink at the lower temperature is relatively high, while the viscosity of the ink at the higher temperature is relatively low. Because of the difference in the viscosity of the ink by the temperature, if the same micro-vibrating signal is applied for the case of the higher temperature and for the case of the lower temperature, the menisci 52 may vibrate with a greater amplitude than a necessary amplitude in the case of the higher temperature, while the menisci 52 may not sufficiently vibrate in the case of the lower temperature.

Therefore, as shown in FIG. 1, in the ink-jetting recording apparatus of the embodiment, a thermistor 100 for measuring the environmental temperature is provided, and an amplitude and a waveform of the micro-vibrating signal (non-recording micro-vibrating signal, pre-recording micro-vibrating signal or mid-recording micro-vibrating signal) can be changed based on the temperature measured by the thermistor 100. For example, the thermistor 100 is mounted on a print substrate (not shown) of the recording head 8 to measure a temperature of a surrounding of the recording head 8 accurately.

The operating-signal generating part 9 has a micro-vibrating-signal determining part 9*b*, which sets the amplitude (voltage) and the waveform (for example, inclinations of rising and falling segments of the trapezoidal pulse 111) of the micro-vibrating common signal in such a manner that the meniscus 52 can minutely vibrate with a stronger force, when the environmental temperature is lower, that is, the viscosity of the ink is higher. The micro-vibrating-signal determining part 9*b* sets the amplitude and the waveform of the micro-vibrating common signal in such a manner that the meniscus 52 can minutely vibrate with a weaker force, when the environmental temperature is higher, that is, the viscosity of the ink is lower. Then, the micro-vibrating-signal generating part 12 as a signal-generating part generates the micro-vibrating common signal based on the amplitude and the waveform set by the micro-vibrating-signal determining part 9*b*.

Thus, in the non-printing and the pre-printing micro-vibrating operations, the meniscus 52 can vibrate with a substantially constant amplitude to stir the ink at the opening of the nozzle most suitably, regardless of the environmental temperature.

Similarly, the operating-signal generating part 9 has a main-signal determining part 9*a*, which sets the amplitude (voltage) and the waveform of the first pulse portion 61 of the jetting operating signal (for example, inclinations of rising and falling segments of the trapezoidal pulse 61*t*) in such a manner that the meniscus 52 can minutely vibrate with a stronger force, when the environmental temperature is lower, that is, the viscosity of the ink is higher. The main-signal determining part 9*b* sets the amplitude and the waveform of the first pulse portion 61 of the jetting operating signal in such a manner that the meniscus 52 can minutely vibrate with a weaker force, when the environmental temperature is higher, that is, the viscosity of the ink is lower. Then, the main-signal generating part 11 as a signal-generating part generates the jetting operating signal based on the amplitude and the waveform set by the main-signal determining part 9*a*.

Thus, in the mid-printing micro-vibrating operation, the meniscus 52 can vibrate with a substantially constant amplitude to stir the ink at the opening of the nozzle most suitably, regardless of the environmental temperature.

Similarly, the respective amplitudes and the respective waveforms of the second pulse portion 62 and the third pulse portion 63 also may be set by the micro-vibrating-signal determining part 9*b* based on the temperature detected by the thermistor 100.

In the above embodiment, the printer includes the recording head 8 having the bending-mode piezoelectric vibrating members 35. However, the printer may include a recording head 70 having a longitudinal-mode piezoelectric vibrating unit 73, instead of the recording head 8.

Figure 17:
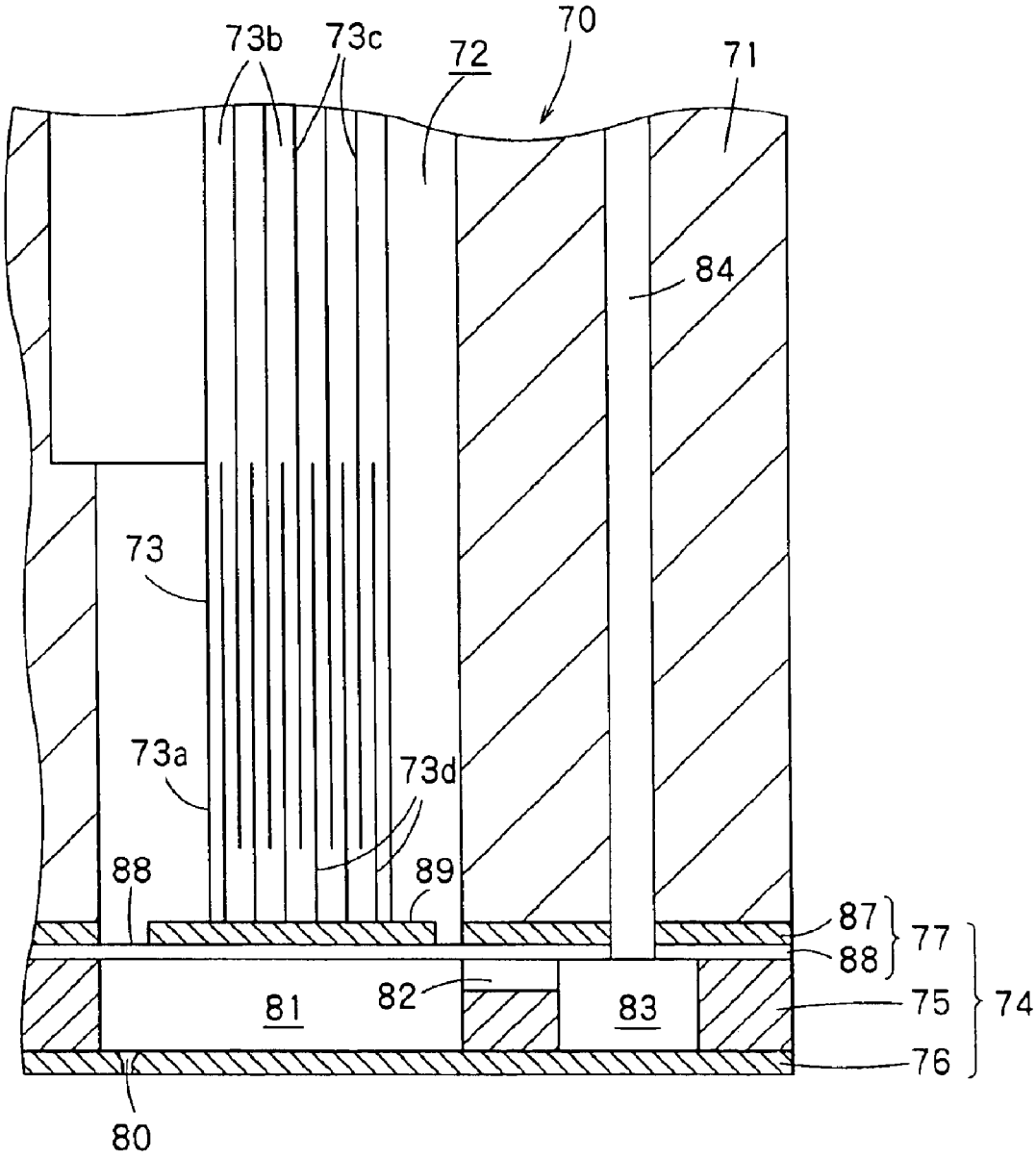
FIG. 17 is a sectional view of a recording head using a longitudinal-vibrating-mode piezoelectric vibrating member.

As shown in FIG. 17, the recording head 70 has a plastic box-like case 71 defining a housing room 72. The longitudinal-mode piezoelectric vibrating unit 73 has a shape of teeth of a comb, and is inserted in the housing room 72 in such a manner that points of teeth-like portions 73*a* of the piezoelectric vibrating unit 73 are aligned at an opening of the housing room 72. An ink-way unit 74 is bonded on a (lower) surface of the case 71 on the side of the opening of the housing room 72. The points of the teeth-like portions 73*a* are fixed at predetermined positions of the ink-way unit 74 to function as piezoelectric vibrating members respectively.

The piezoelectric vibrating unit 73 comprises a plurality of piezoelectric layers 73*b*. Common inside electrodes 73*c* and individual inside electrodes 73*d* are inserted alternately between each adjacent two of the piezoelectric layers 73*b*. The piezoelectric layers 73*b*, the common inside electrodes 73*c* and the individual inside electrodes 73*d* are integrated and cut into the shape of teeth of a comb, correspondingly to dot-forming density. Thus, when a voltage is provided between the common inside electrodes 73*c* and an individual inside electrode 73*d*, a piezoelectric vibrating member contracts in a longitudinal direction of each of the piezoelectric layers 73*b*.

The ink-way unit 74 consists of a nozzle plate 76, an elastic plate 77 and an ink-way forming plate 75 sandwiched between the nozzle plate 76 and the elastic plate 77. The nozzle plate 76, the ink-way forming plate 75 and the elastic plate 77 are integrated.

A plurality of nozzles 80 is formed in the nozzle plate 76. A plurality of pressure generating chambers 81, a plurality of ink-supplying ways 82 and a common ink-chamber 83 are formed in the ink-way forming plate 75. Each of the pressure chambers 81 is defined by partition walls, and is communicated with a corresponding nozzle 80 and with a corresponding ink-supplying way 82 at an end portion thereof. The common ink-chamber 83 is communicated with all the ink-supplying ways 82, and has a longitudinal shape. For example, the longitudinal common ink-chamber 83 may be formed by an etching process when the ink-way forming plate 75 is a silicon wafer. Then, the pressure chambers 81 are formed in the longitudinal direction of the common ink-chamber 83 at the same intervals (pitches) as nozzles 80. Then, a groove as an ink-supplying way 82 is formed between each of the pressure chambers 81 and the common ink-chamber 83. In the case, the ink-supplying way 82 is connected to the end of the pressure chamber 81, while the nozzle 80 is located near the other end of the pressure chamber 81. The common ink-chamber 83 is adapted to supply ink saved in an ink cartridge to the pressure chambers 81. An ink-supplying tube 84 from the ink cartridge is communicated with a middle portion of the common ink-chamber 83.

The elastic plate 77 is layered on a surface of the ink-way forming plate 75 opposed to the nozzle plate 76. In the case, the elastic plate 77 consists of two laminated layers that are a stainless plate 87 and an elastic high-polymer film 88 such as a PPS film. The stainless plate 87 is provided with island portions 89 for fixing the teeth-like portions 73*a* as the piezoelectric vibrating members 73 in respective portions corresponding to the pressure chambers 81, by an etching process.

In the above recording head 70, a teeth-like portion 73*a* as a piezoelectric vibrating member can expand in the longitudinal direction. Then, an island portion 89 is pressed toward the nozzle plate 76, and the elastic film 88 is deformed. Thus, a corresponding pressure chamber 81 contracts. On the other hand, the teeth-like portion 73*a* as the piezoelectric vibrating member can contract from the expanding state in the longitudinal direction. Then, the elastic film 88 is returned to the original state owing to elasticity thereof. Thus, the corresponding pressure chamber 81 expands. By causing the pressure chamber 81 to expand and then causing the pressure chamber 81 to contract, a pressure of the ink in the pressure chamber 81 increases so that the ink drop is jetted from a nozzle 80.

In the recording head 70 as well, the menisci can minutely vibrate in such a manner that the ink drop may not be jetted, in order to stir the ink in the nozzles, by expanding and contracting of the piezoelectric vibrating members.

By the way, in the embodiment, the scanning-position-information outputting unit consists of the linear encoder 27 and the slit detector 29. In addition, the recording-starting-position-information setting unit, the micro-vibrating-starting-position-information setting unit and the micro-vibrating-starting-timing judging unit are adapted to set or judge the recording-starting-position information, the micro-vibrating-starting-position information and the micro-vibrating-starting-timing by means of the counting value corresponding to the detecting signals outputted from the slit detector 29. In the case, the scanning position of the recording head 8 may be surely obtained.

However, this invention can adopt another scanning-position-information outputting unit. For example, if a pattern of the scanning speed of the recording head 8 is fixed regardless of the dot-pattern-data, that is, if the recording head 8 is moved by the same scanning speed pattern, the scanning position of the recording head 8 can be obtained indirectly from a time passed from when the recording head has started scanning.

In the case, the scanning-position-information outputting unit may consist of a scanning-time timer 101 (first-scanning-time timer) for measuring a time passed from a scanning-starting timing (t1). The scanning position of the recording head 8 can be obtained from a timer value of the scanning-time timer 101, because the timer value corresponds to the head-position information.

In the case, the recording-starting-position-information setting unit may set a timer value for the recording-starting-position, which corresponds to the recording-starting-position information. Similarly, the micro-vibrating-starting-position-information setting unit may set a timer value for the micro-vibrating-starting-position, which corresponds to the micro-vibrating-starting-position information.

The micro-vibrating-starting-timing judging unit judges the micro-vibrating-starting timing by comparing the timer value of the scanning-time timer 101 with the timer value for the micro-vibrating-starting-position. Similarly, the recording-starting-timing judging unit judges the record-starting timing by comparing the timer value of the scanning-time timer 101 with the timer value for the recording-starting-position.

As described above, when the scanning position of the recording head 8 can be obtained from the timer value of the scanning-time timer 101, it is not necessary to provide with the linear encoder 27 and the slit detector 29. Thus, the apparatus may become simpler. In addition, the controlling part 6 does not have to watch the detecting signals from the slit detector 29. Thus, the controlling manner may also become simpler, and the processing speed may become faster.

The scanning-time timer 101 is adapted to measure a time passed from when the recording head 8 has started scanning. However, another scanning-time timer 102 (a second-scanning-time timer) can measure a time passed from when the scanning speed of the recording head 8 has become constant. In the case, a standard-passing position is set at a position where the scanning speed of the recording head 8 should become constant, for example at an end position 18A (see FIG. 14) of the recording paper 18 on the side of the home position HP in the width direction. In addition, there is provided a passing sensor that can detect a passing of the recording head 8 above the standard-passing position. Then, the scanning-time timer 102 starts to measure the time based on a detecting signal of the passing sensor. In the case, since the scanning-time timer 102 starts to measure the time passed from when the scanning speed of the recording head 8 has become constant, the scanning position of the recording head 8 can be obtained more accurately.

However, the scanning-position-information outputting unit is not limited to the combination of the linear encoder 27 and the slit detector 29, the scanning-time timer 101, and the scanning-time timer 102. Any scanning-position-information outputting unit capable of outputting information that represents the scanning position of the recording head 8 may be adopted.

For example, when the carriage 21 is reciprocated in the main scanning direction by a ball-spline mechanism, a rotary encoder may be attached to a rotating shaft of the ball-spline mechanism in such a manner that the rotary encoder rotates together with the rotating shaft, and a slit detector may be provided for detecting slits of the rotary encoder. In the case, the recording-starting-position and the micro-vibrating-starting-position can be recognized from detecting signals from the slit detector.

In the embodiment, the controlling part 6 functioning as a micro-vibrating controlling unit is adapted to supply the operating signal generated by the operating-signal generating part 9 (the main signal generating part 11 and the micro-vibrating-signal generating part 12) to the recording head 8. However, another micro-vibrating controlling unit can be adopted.

In the embodiment, the recording-starting-position-information setting unit is adapted to set the recording-starting-position of the recording head 8 based on the dot-pattern data. However, data for setting the recording-starting-position are not limited to the dot-pattern-data. For example, the recording-starting-position may be set based on printing data (one kind of recording data) from the host computer, or based on intermediate data (one kind of recording data).

In the embodiment, the printer includes the recording head 8 having the pressure chambers 36 that can expand and contract by means of the piezoelectric vibrating members 35. However, this invention can also apply to a printer or a plotter including a bubble-jet recording head that can jet ink drop from a nozzle by changing a size of air bubble generated in a pressure chamber.

Figure 18:
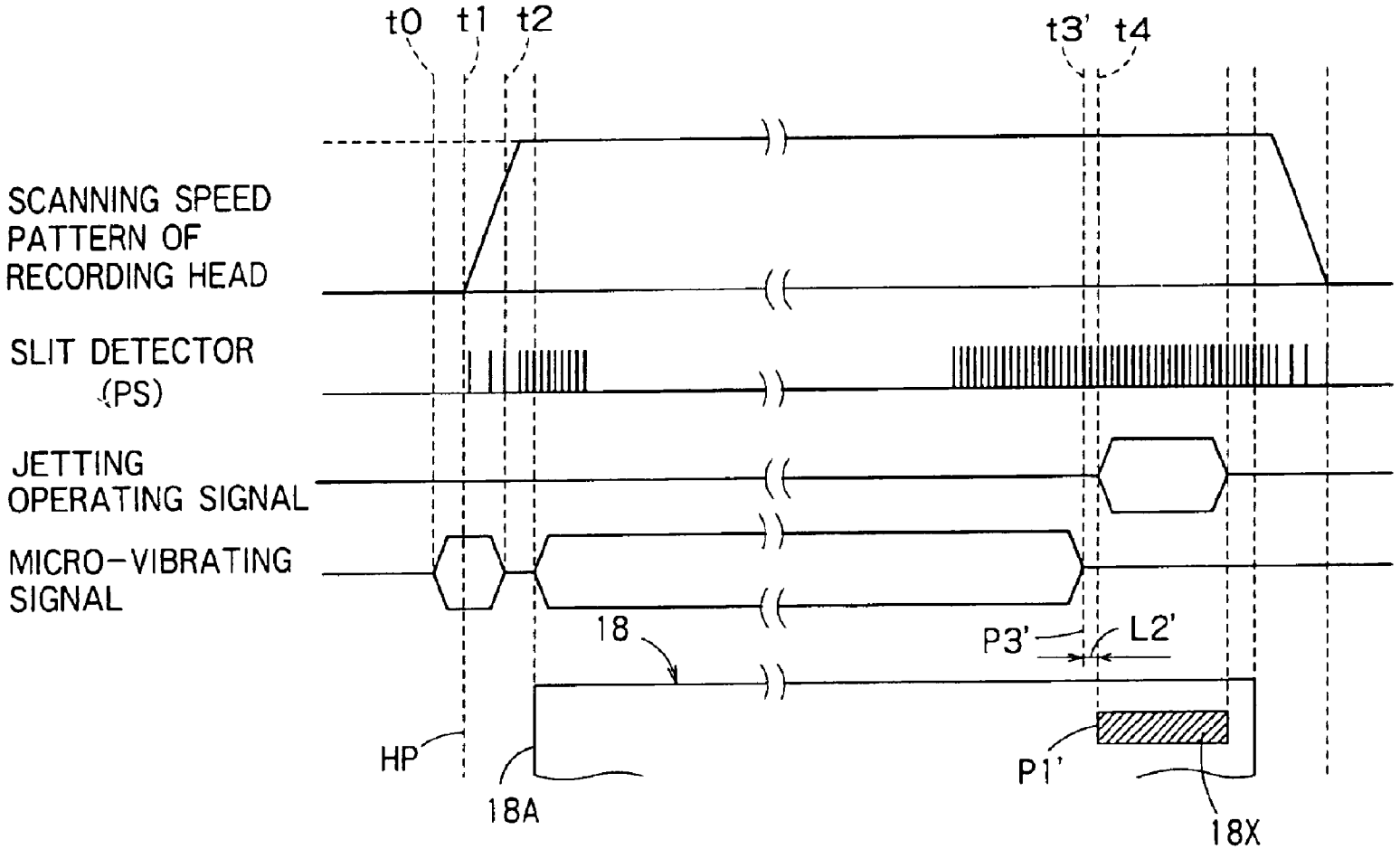
FIG. 18 is another timing chart for explaining a recording operation for one line.
Figure 19:
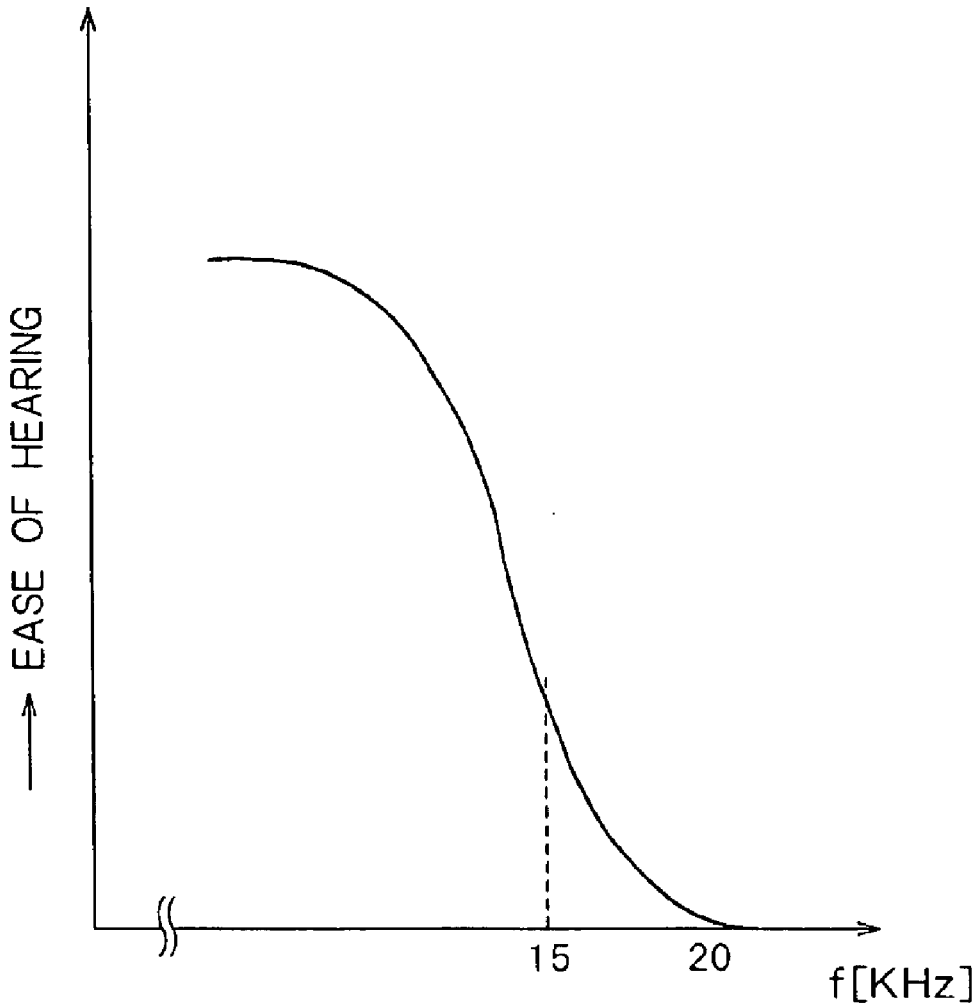
FIG. 19 is a graph showing a hearable frequency band for human ears.

FIG. 18 is another timing chart for explaining a scanning operation including a recording operation for a line. As shown in FIG. 18, the controlling part 6 functions as a micro-vibrating-ceasing-position-information setting unit to set micro-vibrating-ceasing-position information that represents a position where the micro-vibrating unit should cease to cause the ink to minutely vibrate, for example just before starting the recording operation. For example, the micro-vibrating-ceasing-position is set at a position P3' back to the home position HP from the recording-starting-position P1' by a distance L2' that is necessary for the menisci to settle down after minutely vibrating. That is, the setting of the micro-vibrating-ceasing-position P3' is carried out based on the recording-starting-position information that has been set previously. Then, a counting value obtained by subtracting a counting value corresponding to the distance L2' from a counting value corresponding to the recording-starting-position P1' is set as a counting value corresponding to the micro-vibrating-ceasing-position P3'.

In the case shown in FIG. 18, the micro-vibrating-starting-position is set at the end position 18A of the recording paper 18 on the side of the home position HP in the width direction, regardless of the recording-starting-position information. Of course, the micro-vibrating-starting-position in the case may be set based on the recording-starting-position information.

Figure 6:
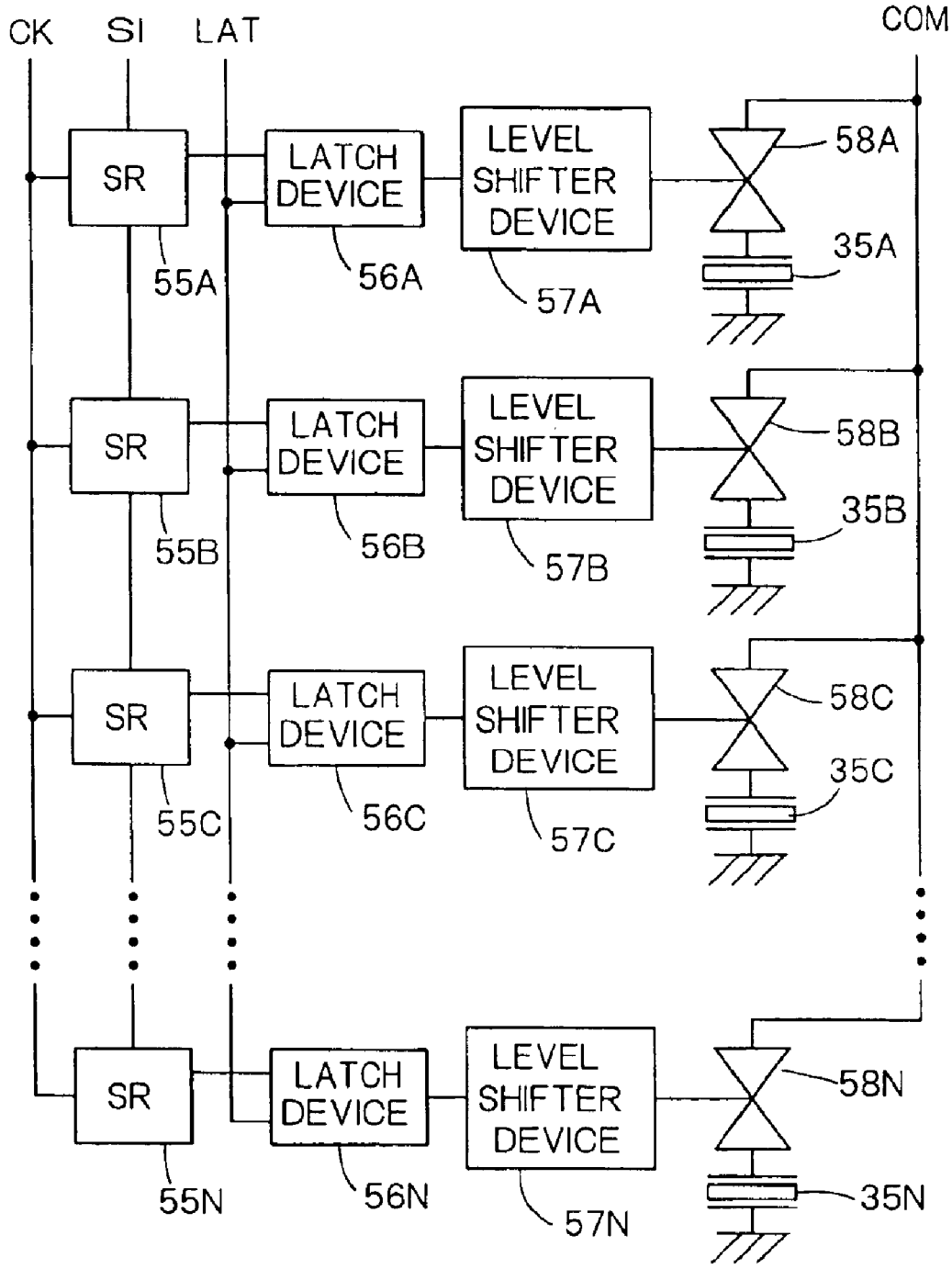
FIG. 6 is a block diagram for explaining an electric structure of the recording head.

When the controlling part 6 judges that it is the pre-recording micro-vibrating-starting timing just before the recording operation, the controlling part 6 functions as a pre-recording micro-vibrating controlling unit (one kind of micro-vibrating controlling unit) to supply a pre-recording micro-vibrating signal to the piezoelectric vibrating members 35 (S15: see FIG. 16A). That is, the controlling part 6 outputs such a controlling signal to the choosing part 13 that the non-recording common micro-vibrating signal from the micro-vibrating-signal generating part 12 is allowed to be supplied to the piezoelectric vibrating members 35. Then, the controlling part 6 sets the respective bit-data of the mode bit signal in the shift register 55, and outputs the latch signals to the latch circuit 56 to generate the micro-vibrating signal corresponding to the characteristic of increasing viscosity of the ink and supply the micro-vibrating signal to the piezoelectric vibrating members 35 (see FIG. 6). Then, the controlling part 6 supplies an operating pulse to the pulse motor 25 to move the carriage 21 in the main scanning direction. Thus, the recording head 8 starts scanning. If a stopping timing (t3') for the non-recording micro-vibrating signal is judged, the non-recording common micro-vibrating signal stops being supplied from the micro-vibrating-signal generating unit 12. Thus, the non-recording micro-vibrating operations are stopped. In the case, the stopping timing (t3') can be judged by comparing a counting value of the position counter with a predetermined counting value P3'.

As described above, according to the timing chart shown in FIG. 18, the menisci of the ink in the nozzles can be caused to minutely vibrate till a suitable timing (t3') just before an ink drop is jetted from a nozzle. To cause the menisci to keep minutely vibrating till the suitable timing is very effective when the ink includes pigments and thus the viscosity of the ink is liable to increase.

According to the timing chart shown in FIG. 18, in general, the micro-vibrating control tends to continue for a longer time. Thus, reduction of the noise according to the invention may have a more important meaning.

In the embodiment, the recording-starting-position of the recording head 8 means a position where one of the nozzles of the recording head 8 starts to record, i.e., jet the ink. However, in general, the nozzles start to record at different positions respectively. Thus, it is preferable to take into consideration respective recording-starting-positions of the nozzles.

That is, preferably, the nozzles are classified into at least two classes, and the controlling part 6 functioning as a recording-starting-position setting unit is adapted to set recording-starting-position information that represents positions where a nozzle of the respective classes should start to record. Then, the controlling part 6 functioning as a micro-vibrating-starting-position setting unit may determine whether to cause the ink in the nozzle or the nozzles of the respective classes to minutely vibrate based on the recording-starting-position information, and may set micro-vibrating-starting-position information that represents respective positions where the micro-vibrating unit should start to cause the ink in the nozzle or the nozzles of the respective classes to minutely vibrate based on the recording-starting-position information if it is determined to cause the ink in the nozzle or the nozzles of the respective classes to minutely vibrate. Then, the controlling part 6 functioning as a pre-recording micro-vibrating controlling unit may judge respective micro-vibrating-starting timings for the nozzle or the nozzles of the respective classes, based on the micro-vibrating-starting-position information and the head-position information, in order to cause the micro-vibrating unit to operate.

The classified class may include only one nozzle. In the case, the micro-vibrating operations of the respective nozzles may be carried out at the respective different phases.

Figure 20:
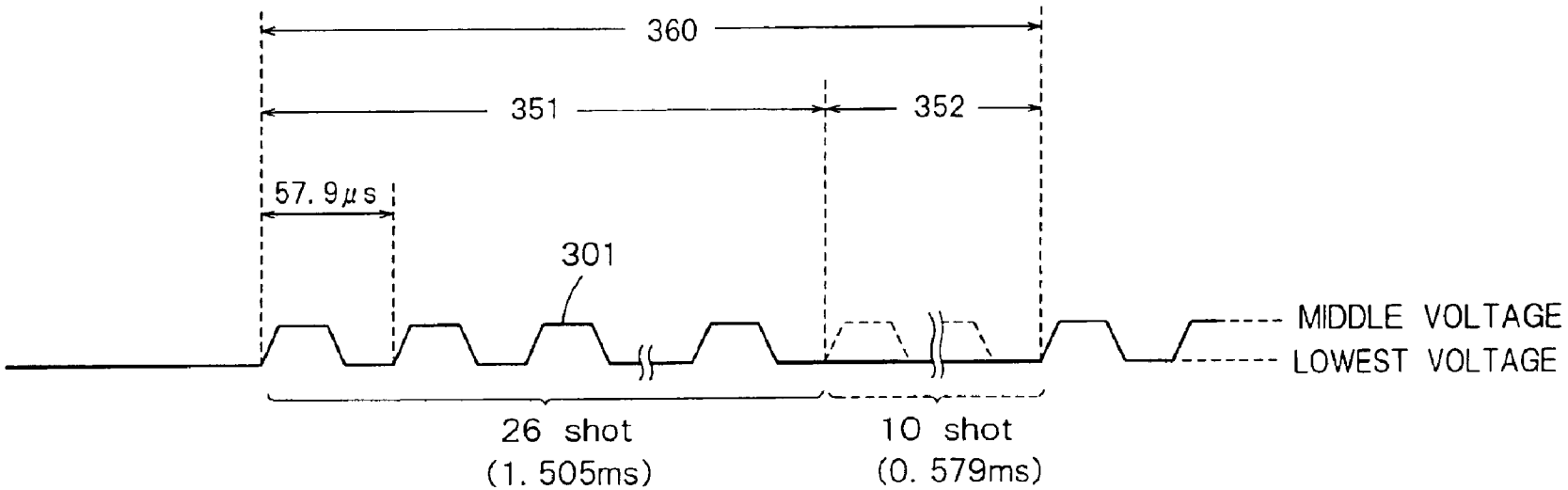
FIG. 20 is an explanatory view of another example of micro-vibrating operating signal.

Next, a case wherein the common micro-vibrating signal shown in FIG. 20 is used is explained.

As described above, the non-recording common micro-vibrating signal and the pre-recording common micro-vibrating signal are usually the same signal. In the example shown in FIG. 20, the common micro-vibrating signal is-formed by a periodical signal wherein a unit waveform 360 is repeated at a second frequency, the unit waveform 360 including in order a first waveform part 351 in which a trapezoidal pulse 301 (pulse waveform) appears at a first frequency and a second waveform part 352 in which no pulse waveform appears, each trapezoidal pulse being switched between a lowermost potential and a middle potential.

In this embodiment, the first frequency is 17.27 kHz (period: 57.9 μs). The first waveform part 351 includes 26 shots of the pulses 301 that appear at the first frequency. That is, a continuing time of the first waveform part 351 is 57.9 μs×26=1.505 ms.

On the other hand, the second waveform part 352 corresponds to 10 shots of the pulses 301 that appear at the first frequency. That is, a continuing time of the second waveform part 352 is 57.9 μs×10=0.579 ms.

Thus, the second frequency is 479.7 Hz, which corresponds to the period of 57.9 μs×36=2.0844 ms.

In this case, a ratio r of the continuing time of the first waveform part 351 (1.505 ms) with respect to the continuing time of the unit waveform 360 (2.0844 ms) is 26/36. This corresponds to the ratio of the numbers of shots of the pulses 301.

In the case, the shift register 55, the latch circuit 56, the level shifter 57, the switching unit 58 and the controlling part 6 are adapted to function as a micro-vibrating-signal supplying unit. That is, as a micro-vibrating operating signal (micro-vibrating controlling signal), they can supply a non-recording common micro-vibrating signal or a pre-recording common micro-vibrating signal from the micro-vibrating-signal generating part 12 to the recording head 8 (piezoelectric vibrating members 35). Alternatively, they can generate a mid-recording micro-vibrating signal from a jetting operating signal, and output (supply) the signal to the recording head 8.

Next, an operation for causing the meniscus 52 to minutely vibrate by means of the non-recording common micro-vibrating signal or the pre-recording common micro-vibrating signal shown in FIG. 20 in order to stir the ink is explained.

In the case, the controlling part 6 transfers in a serial manner and sets in turn the bit-data of "1" from the outputting buffer 4C to the shift register devices 55A to 55N respectively, suitably synchronously with the clock signal (CK) from the oscillating circuit 7. When the bit-data for all the nozzles 51 are set in the shift register devices 55A to 55N, the controlling part 6 outputs latch signals (LAT) to the latch circuit 56 i.e. the latch devices 56A to 56N at a suitable timing. Owing to the latch signals, the latch devices 56A to 56N latch the bit-data set in the shift register devices 55A to 55N, respectively. The latched bit-data are supplied to the level shifter 57 i.e. the level shifter devices 57A to 57N, respectively. The level shifter 57 is adapted to function as a voltage amplifier.

For example, each of the level shifter devices 57A to 57N raises the datum (bit-data) "1" to a voltage of several decade volt that can drive the switching unit 58. The raised datum (signal) is applied to the switching unit 58 i.e. each of the switching devices 58A to 58N (a signal fusing part). Each of the switching devices 58A to 58N is closed (connected) by the signal.

The non-recording common micro-vibrating signal or the pre-recording common micro-vibrating signal from the micro-vibrating-signal generating part 12 is applied to each of the switching devices 58A to 58N. As each of the switching devices 58A to 58N is closed, the non-recording common micro-vibrating signal or the pre-recording common micro-vibrating signal is supplied to each of the piezoelectric vibrating members 35A to 35N that are connected to the switching devices 58A to 58N.

When the micro-vibrating signal is supplied to the piezoelectric vibrating members 35, the pressure generating chambers 36 repeat to minutely expand and contract. Thus, as shown in FIG. 5B, the meniscus 52 can be minutely vibrated between a position of a jetting side and a position of a contracting side nearer to the pressure chamber 36. In FIG. 5B, the position of the jetting side is designated by a broken line, and the position of the contracting side is designated by a real line. Owing to the vibration of the meniscus 52, the ink at the opening of the nozzle can be stirred.

In this embodiment, characteristics about recovering viscosity of the ink from an increased state thereof and about preventing generation of the dripping with the ink at the nozzle greatly depend on the first frequency of the micro-vibrating signal. The first frequency is 17.27 kHz, which satisfies a condition of a preferable range not less than 10.8 kHz and not more than 25.0 kHz found by the inventors about recovering viscosity of the ink from an increased state thereof and about preventing generation of the dripping with the ink at the nozzle. Thus, the micro-vibrating controlling operation of this embodiment is superior in the characteristics about recovering viscosity of the ink from an increased state thereof and about preventing generation of the dripping with the ink at the nozzle.

Herein, in view of the number of micro-vibrations for a unit time, it can be said that this embodiment achieves a micro-vibrating controlling operation corresponding to 17.27 kHz×(26/36)=12.5 kHz. The value of 12.5 kHz also satisfies the condition of not less than 10.8 kHz and not more than 25.0 kHz.

Characteristic about easiness of forming a driving circuit for the micro-vibrating unit greatly depends on the first frequency of the micro-vibrating signal and a ratio of time between the first waveform part 351 and the unit waveform 360. The first frequency is 17.27 kHz, and the ratio of time between the first waveform part 351 and the unit waveform 360 is 26/36. Thus, a load of the driving circuit for the micro-vibrating unit can be thought to correspond to 17.27 kHz×(26/36)=12.5 kHz. The value of 12.5 kHz satisfies a condition of a preferable range not more than 13.0 kHz found by the inventors about easiness of forming a driving circuit for the micro-vibrating unit. Thus, the micro-vibrating controlling operation of this embodiment is superior in the characteristic about easiness of forming a driving circuit for the micro-vibrating unit as well.

Characteristic about suppressing generation of the noise greatly depends on the second frequency of the micro-vibrating signal. The second frequency is 479.7 Hz (about 480 Hz), which satisfies a condition-of a preferable range not less than 100 Hz and not more than >1.0 kHz found by the inventors about suppressing generation of the noise. Thus, the micro-vibrating controlling operation of this embodiment is superior in the characteristic about suppressing generation of the noise as well.

Herein, the following table 2 shows a relationship between second frequencies and effect in suppressing generation of the noise.

TABLE 2

| Second Frequency | Effect |
|---|---|
| 2000 Hz | x |
| 1500 Hz | x |
| 1000 Hz | ○ |
| 600 Hz | ○ |
| 480 Hz | ○ |
| 300 Hz | ○ |
| 100 Hz | ○ |

As described above, when the common micro-vibrating signal shown in FIG. 20 is used, a common micro-vibrating controlling operation can be carried out for all the nozzles at the same time. Thus, even if the micro-vibrating period is not shifted (staggered) for respective classes of nozzles or for respective nozzles, the micro-vibrating controlling operation is superior in the characteristics about recovering viscosity of the ink from an increased state thereof and about preventing generation of the dripping with the ink at the nozzle, as well as in the characteristic about suppressing generation of the noise.

In addition, as described above, the printer controller 1 consists of the computer system. However, a program for materializing the above element or elements (unit or units) in a computer system, and a storage unit storing the program and capable of being read by a computer, are intended to be protected by this application.

When the above element or elements may be materialized in the computer system by using a general program such as an OS, a program including a command or commands for controlling the general program, and a storage unit storing the program and capable of being read by a computer, are also intended to be protected by this application.

This invention is intended to apply to not only ink jetting recording apparatuses but also general liquid jetting apparatuses widely. A liquid may be glue, nail polish or the like, instead of the ink.

What is claimed is:

1. A liquid jetting apparatus comprising:

a head member having a nozzle, a micro-vibrating unit that causes liquid in the nozzle to minutely vibrate, a micro-vibrating-controlling-signal generating unit that generates a micro-vibrating controlling signal, and a micro-vibrating controlling unit that causes the micro-vibrating unit to operate, based on the micro-vibrating controlling signal, wherein the micro-vibrating-controlling-signal generating unit is adapted to generate a micro-vibrating controlling signal as a signal in which a unit waveform is repeated at a second frequency, the unit waveform including in order a first waveform part in which a pulse waveform appears at a first frequency and a second waveform part in which no pulse waveform appears, and the second frequency is not less than 100 Hz;

wherein when a ratio of a continuing time of the first waveform part with respect to a continuing time of the unit waveform is represented by r, a product of the first frequency and r is not less than 10.8 kHz and not more than 25.0 kHz.

2. A liquid jetting apparatus comprising:

a head member having a nozzle, a micro-vibrating unit that causes liquid in the nozzle to minutely vibrate, a micro-vibrating-controlling-signal generating unit that generates a micro-vibrating controlling signal, and a micro-vibrating controlling unit that causes the micro-vibrating unit to operate, based on the micro-vibrating controlling signal, wherein the micro-vibrating-controlling-signal generating unit is adapted to generate a micro-vibrating controlling signal as a signal in which a unit waveform is repeated at a second frequency, the unit waveform including in order a first waveform part in which a pulse waveform appears at a first frequency and a second waveform part in which no pulse waveform appears, and the second frequency is not less than 100 Hz;

wherein when a ratio of a continuing time of the first waveform part with respect to a continuing time of the unit waveform is represented by r, a product of the first frequency and r is not more than 13 kHz.

3. A liquid jetting apparatus comprising:

a head member having a nozzle, a micro-vibrating unit that causes liquid in the nozzle to minutely vibrate, a micro-vibrating-controlling-signal generating unit that generates a micro-vibrating controlling signal, and a micro-vibrating controlling unit that causes the micro-vibrating unit to operate, based on the micro-vibrating controlling signal, wherein the micro-vibrating-controlling-signal generating unit is adapted to generate a micro-vibrating controlling signal as a signal in which a unit waveform is repeated at a second frequency, the unit waveform including in order a first waveform part in which a pulse waveform appears at a first frequency and a second waveform part in which no pulse waveform appears, and the second frequency is not less than 100 Hz;

wherein when a ratio of a continuing time of the first waveform part with respect to a continuing time of the unit waveform is represented by r, a product of the first frequency and r is not less than 10.8 kHz and not more than 13 kHz.

4. A controlling unit for controlling a liquid jetting apparatus including: a head member having a nozzle; and a micro-vibrating unit that causes liquid in the nozzle to minutely vibrate; the controlling unit comprising:

a micro-vibrating-controlling-signal generating unit that generates a micro-vibrating controlling signal, and a micro-vibrating controlling unit that causes the micro-vibrating unit to operate, based on the micro-vibrating controlling signal, wherein the micro-vibrating-controlling-signal generating unit is adapted to generate a micro-vibrating controlling signal as a signal in which a unit waveform is repeated at a second frequency, the unit waveform including in order a first waveform part in which a pulse waveform appears at a first frequency and a second waveform part in which no pulse waveform appears, and the second frequency is not less than 100 Hz;

wherein when a ratio of a continuing time of the first waveform part with respect to a continuing time of the unit waveform is represented by r, a product of the first frequency and r is not less than 10.8 kHz and not more than 25.0 kHz.

5. A controlling unit for controlling a liquid jetting apparatus including: a head member having a nozzle; and a micro-vibrating unit that causes liquid in the nozzle to minutely vibrate; the controlling unit comprising:

a micro-vibrating-controlling-signal generating unit that generates a micro-vibrating controlling signal, and a micro-vibrating controlling unit that causes the micro-vibrating unit to operate, based on the micro-vibrating controlling signal, wherein the micro-vibrating-controlling-signal generating unit is adapted to generate a micro-vibrating controlling signal as a signal in which a unit waveform is repeated at a second frequency, the unit waveform including in order a first waveform part in which a pulse waveform appears at a first frequency and a second waveform part in which no pulse waveform appears, and the second frequency is not less than 100 Hz;

wherein when a ratio of a continuing time of the first waveform part with respect to a continuing time of the unit waveform is represented by r, a product of the first frequency and r is not more than 13 kHz.

6. A controlling unit for controlling a liquid jetting apparatus including: a head member having a nozzle; and a micro-vibrating unit that causes liquid in the nozzle to minutely vibrate; the controlling unit comprising:

a micro-vibrating-controlling-signal generating unit that generates a micro-vibrating controlling signal, and a micro-vibrating controlling unit that causes the micro-vibrating unit to operate, based on the micro-vibrating controlling signal, wherein the micro-vibrating-controlling-signal generating unit is adapted to generate a micro-vibrating controlling signal as a signal in which a unit waveform is repeated at a second frequency, the unit waveform including in order a first waveform part in which a pulse waveform appears at a first frequency and a second waveform part in which no pulse waveform appears, and the second frequency is not less than 100 Hz;

wherein when a ratio of a continuing time of the first waveform part with respect to a continuing time of the unit waveform is represented by r, a product of the first frequency and r is not less than 10.8 kHz and not more than 13 kHz.

* * * * *